US008525733B2

(12) United States Patent
Kitchener et al.

(10) Patent No.: US 8,525,733 B2
(45) Date of Patent: Sep. 3, 2013

(54) LOW-PROFILE WIDE-BANDWIDTH RADIO FREQUENCY ANTENNA

(71) Applicant: Apple Inc., Cupertino, CA (US)

(72) Inventors: Dean Kitchener, Essex (GB); Andrew Urquhart, Hertfordshire (GB)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/764,899

(22) Filed: Feb. 12, 2013

(65) Prior Publication Data

US 2013/0162498 A1 Jun. 27, 2013

Related U.S. Application Data

(63) Continuation of application No. 13/229,870, filed on Sep. 12, 2011, now Pat. No. 8,416,137, which is a continuation of application No. 12/415,604, filed on Mar. 31, 2009, now Pat. No. 8,040,289.

(60) Provisional application No. 61/050,028, filed on May 2, 2008.

(51) Int. Cl.
*H01Q 1/38* (2006.01)
*H01Q 1/50* (2006.01)

(52) U.S. Cl.
USPC ..... 343/700 MS; 343/846; 343/860

(58) Field of Classification Search
USPC ..... 343/700 MS, 846, 860
See application file for complete search history.

(56) References Cited

U.S. PATENT DOCUMENTS

| | | | |
|---|---|---|---|
| 6,317,084 | B1 | 11/2001 | Chen et al. |
| 6,426,723 | B1 | 7/2002 | Smith et al. |
| 6,831,607 | B2 | 12/2004 | Hebron et al. |
| 6,847,329 | B2 | 1/2005 | Ikegaya et al. |
| 6,903,690 | B2 | 6/2005 | Leclerc et al. |
| 7,256,743 | B2 | 8/2007 | Korva |
| 7,345,634 | B2 | 3/2008 | Ozkar et al. |
| 2002/0126051 | A1 | 9/2002 | Jha |
| 2004/0145525 | A1 | 7/2004 | Annabi et al. |
| 2005/0280589 | A1 | 12/2005 | Chiang et al. |
| 2006/0038721 | A1 | 2/2006 | Ozkar et al. |

FOREIGN PATENT DOCUMENTS

| | | | |
|---|---|---|---|
| CN | 2865039 | Y | 1/2007 |
| EP | 1052723 | A2 | 11/2000 |
| EP | 1315238 | A2 | 5/2003 |
| EP | 1536511 | A1 | 6/2005 |

OTHER PUBLICATIONS

First Office Action and Search Report in Chinese Application No. 200980125509.6, issued Dec. 28, 2012, pp. 1-27.

(Continued)

*Primary Examiner* — Hoang V Nguyen
(74) *Attorney, Agent, or Firm* — Meyertons, Hood, Kivlin, Kowert & Goetzel, P.C.

(57) ABSTRACT

The present invention relates to an RE antenna structure that includes a planar structure and a loading plate, such that the planar structure is mounted between a ground plane and the loading plate to form an RF antenna. The loading plate may be about parallel to the ground plane and the planar structure may be about perpendicular to the loading plate and the ground plane. The loading plate may allow the height of the RF antenna structure above the ground plane to be relatively small. For example, the height may be significantly less than one-quarter of a wavelength of RF signals of interest. The planar structure may include two conductive matching elements to help increase the bandwidth of the RF antenna structure.

20 Claims, 29 Drawing Sheets

(56) References Cited

OTHER PUBLICATIONS

European Search Report for European Patent Application No. 09738448.1, issued Jan. 25, 2012, 6 pages.

Schulteis et al.; "Performance of a PDA Equipped with 3 Dual-band Inverted F Antennas for MIMO and Diversity Systems;" Proceedings of the 2006 ITG Workshop on Smart Antennas, Mar. 2006, Ulm, Germany, 6 pages.

International Search Report for PCT/IB2009/005139, mailed Aug. 24, 2009, 3 pages.

Kitchener et al.; "Low Cost Diversity Antennas for Low Power Wireless Basestations;" Proceedings of the 10th International Conference on Antennas and Propagation, Apr. 14-17, 1997, pp. 1.445-1.447, Conference Publication No. 436, IEEE.

Liu et al., "Laptop Antenna Design and Evaluation," Chapter 4 of Antennas for Portable Devices, 2007, Edited by Zhi Ning Chen, pp. 113-166, John Wiley & Sons, Ltd.

Manteghi et al., "Novel Compact Tri-Band Two-Element and Four-Element MIMO Antenna Designs," Proceedings of the Antennas and Propagation Society International Symposium, Jul. 9-14, 2006, pp. 4443-4446, IEEE.

Martinez-Vazquiz, M., "ACE Small Terminal Antennas Activities: A Review of the State of the Art," Proceedings of the 18th International Conference on Applied Electromagnetics and Communications, Oct. 12-14, 2005, pp. 1-4, IEEE.

Notice of Allowance for U.S. Appl. No. 12/415,604, mailed Jun. 9, 2011, 7 pages.

LOW-PROFILE WIDE-BANDWIDTH RADIO FREQUENCY ANTENNA

This application is a Continuation of U.S. patent application Ser. No. 13/229,870, entitled LOW-PROFILE WIDE-BANDWIDTH RADIO FREQUENCY ANTENNA, filed Sep. 12, 2011, which is a Continuation of U.S. patent application Ser. No. 12/415,604, entitled LOW-PROFILE WIDE-BANDWIDTH RADIO FREQUENCY ANTENNA, filed Mar. 31, 2009, now U.S. Pat. No. 8,040,289, which claims the benefit of U.S. Provisional Patent Application Ser. No. 61/050,028, entitled ANTENNAS FOR WLAN ACCESS POINTS, filed May 2, 2008, the disclosures of which are both hereby incorporated by reference in their entireties.

FIELD OF THE INVENTION

Embodiments of the present invention relate to radio frequency (RF) antennas, which may be used in RF communications systems.

BACKGROUND OF THE INVENTION

As technology progresses, wireless devices tend toward smaller sizes and wireless communications protocols become increasingly sophisticated. Support for multiple communications bands with wider bandwidths in a single device is becoming available. For example, the Institute for Electrical and Electronics Engineers (IEEE) 802.11n wireless communications standard specifies support for wireless communications using a first communications band between about 2.4 gigahertz (GHz) and about 2.4835 GHz, and a second communications band between about 4.9 GHz and 5.825 GHz. Therefore, the second communications band has a bandwidth of about 17.25%.

A wireless local area network (WLAN) access point may be installed in a hot spot to provide wireless access to end users. The WLAN access point may need to be compact for ease and flexibility of installation. Therefore, any radio frequency (RF) antennas installed in the WLAN access point may have significant size and dimension restrictions. For example, any RF antenna in a WLAN access point may be restricted in height to about 12 millimeters (mm). Additionally, the WLAN access point may be a multiple-input multiple-output (MIMO) WLAN access point, which utilizes multiple antennas. Therefore, the RF antennas in a MIMO WLAN access point may have additional size and dimension restrictions, and may need to be of reasonable cost. If a WLAN access point supports communications using the IEEE 802.11n communications protocol, an RF antenna in the WLAN access point may need to support the 2.4 GHz to 2.4835 GHz communications band, the 4.9 GHz and 5.825 GHz communications band, or both, Further, if a MIMO WLAN access point supports communications using the IEEE 802.11n communications protocol, one or more RF antennas in the access point may be a single band antenna for isolation from other bands, or one or more RF antenna in the access point may support two or more communication bands to minimize the number of RF antennas. Thus, there is a need for an RF antenna that is small, cost effective, wide bandwidth, dual band, or any combination thereof.

SUMMARY OF THE EMBODIMENTS

The present invention relates to an RF antenna structure that includes a planar structure and a loading plate, such that the planar structure is mounted between a ground plane and the loading plate to form an RF antenna. The loading plate may be about parallel to the ground plane and the planer structure may be about perpendicular to the loading plate and the ground plane. The loading plate may allow the height of the RF antenna structure above the ground plane to be relatively small. For example, the height may be significantly less than one-quarter of a wavelength of RF signals of interest. The planar structure may include two conductive matching elements to help increase the bandwidth of the RF antenna structure. In one embodiment of the present invention, the bandwidth of the RF antenna may be greater than about 15 percent of the center frequency of a communications band of interest.

All or part of the RF antenna structure may include metal rods, stamped metal, printed circuits, or any combination thereof. In one embodiment of the present invention, the RF antenna is a single band RF antenna. In an alternate embodiment of the present invention, the RF antenna is a dual band RF antenna. The RF antenna may be used in a wireless local area network (WLAN) access point. The WLAN access point may be a multiple-input multiple-output (MIMO) WLAN access point, in which case the MIMO WLAN access point will include two or more RF antenna elements. The WLAN access point may operate using the IEEE 802.11n wireless communications standard and may utilize the 2.4 GHz to 2.4835 GHz communications band, the 4.9 GHz and 5.825 GHz communications band, or both.

Those skilled in the art will appreciate the scope of the present invention and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 3:
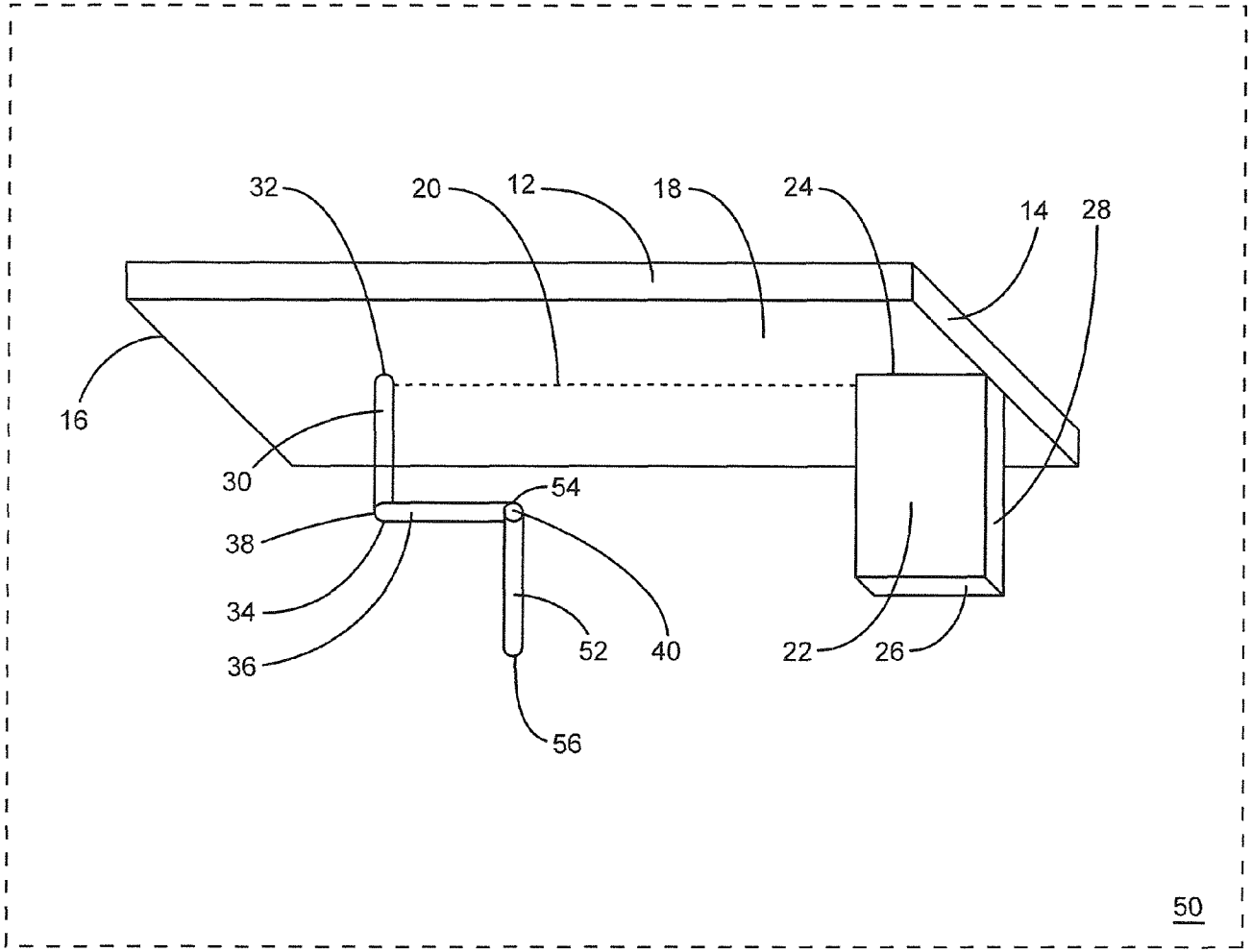
FIG. 3 shows a three-dimensional view from one side and underneath a dual band RF antenna structure according to an alternate embodiment of the present invention.
Figure 4:
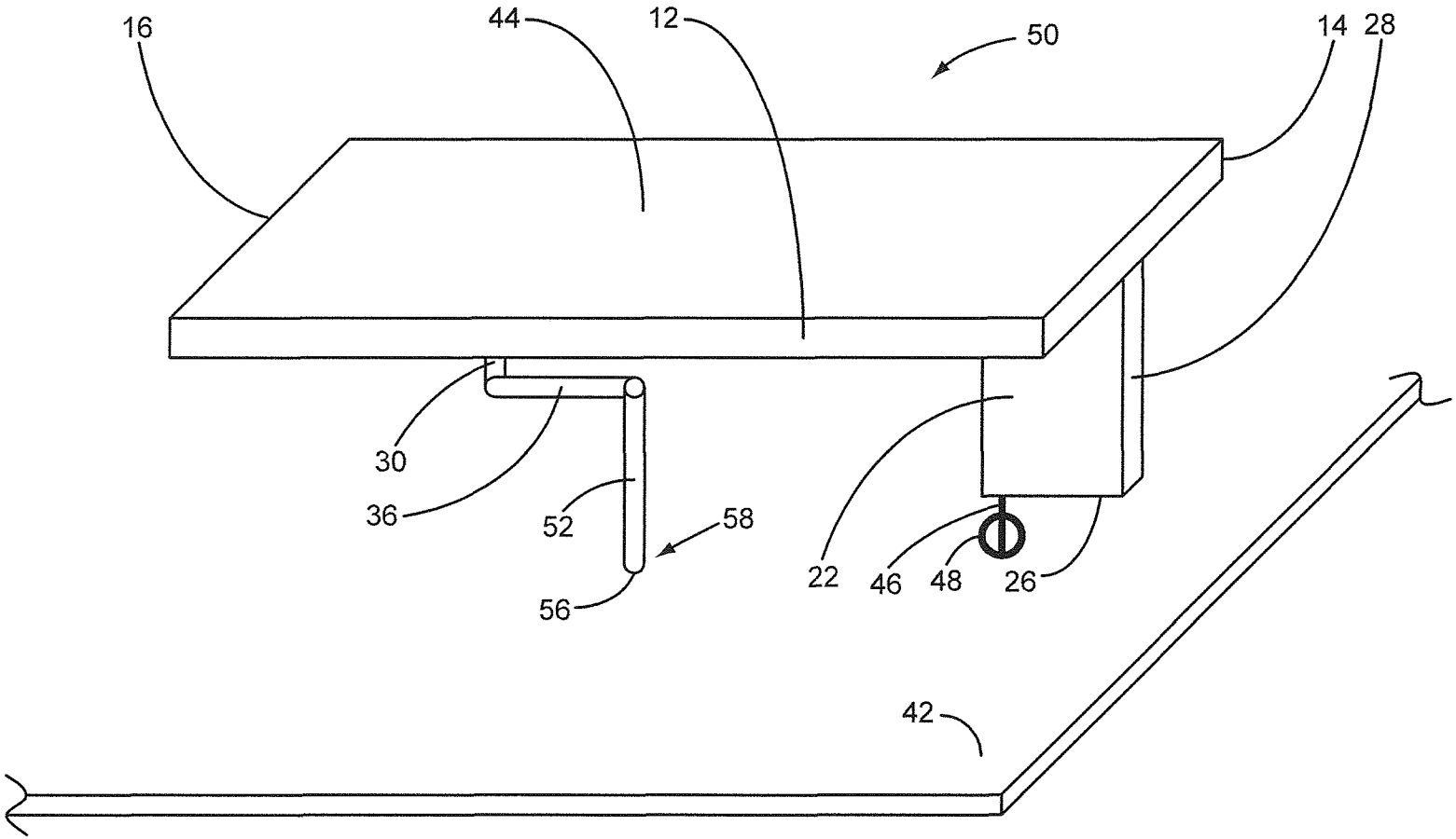

FIG. 4 snows a three-dimensional view from one side and above the dual band RF antenna structure illustrated in FIG. 3.

Figure 5:
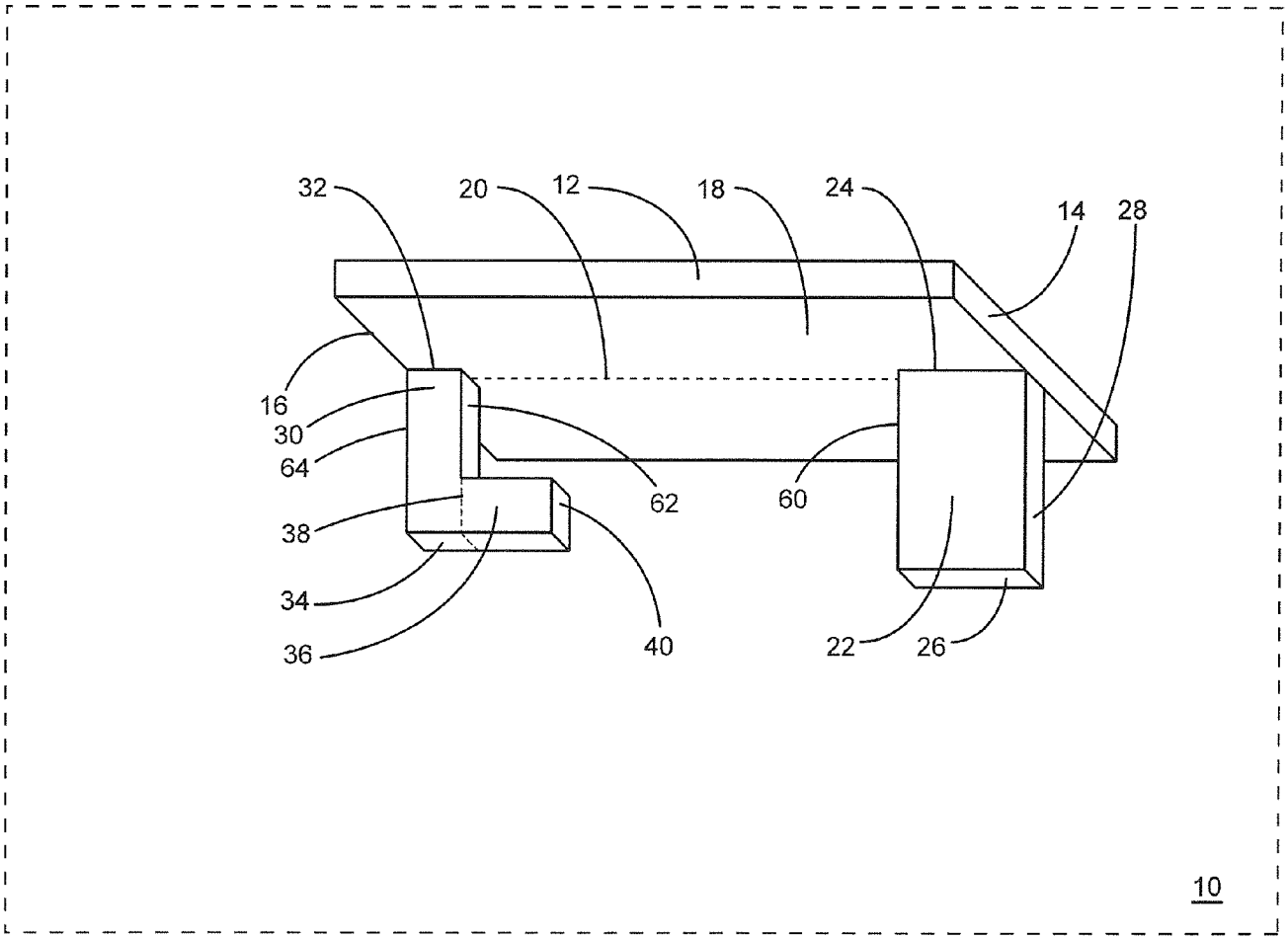

FIG. 5 shows a three-dimensional view from one side and underneath the RF antenna structure according to an alternate embodiment of the RF antenna structure.

Figure 6:
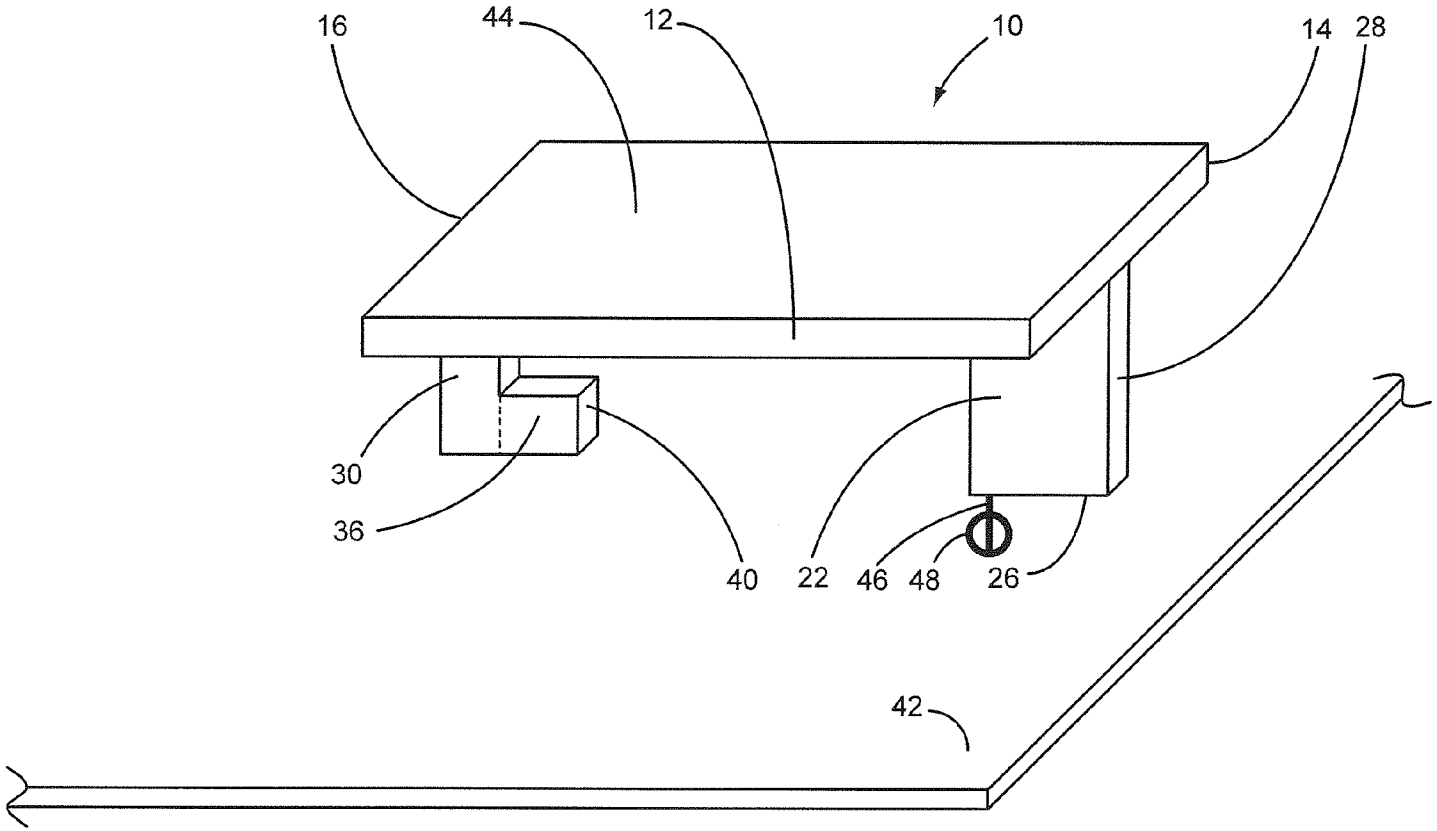

FIG. 6 shows a three-dimensional view from one side and above the RF antenna structure illustrated in FIG. 5.

Figure 7:
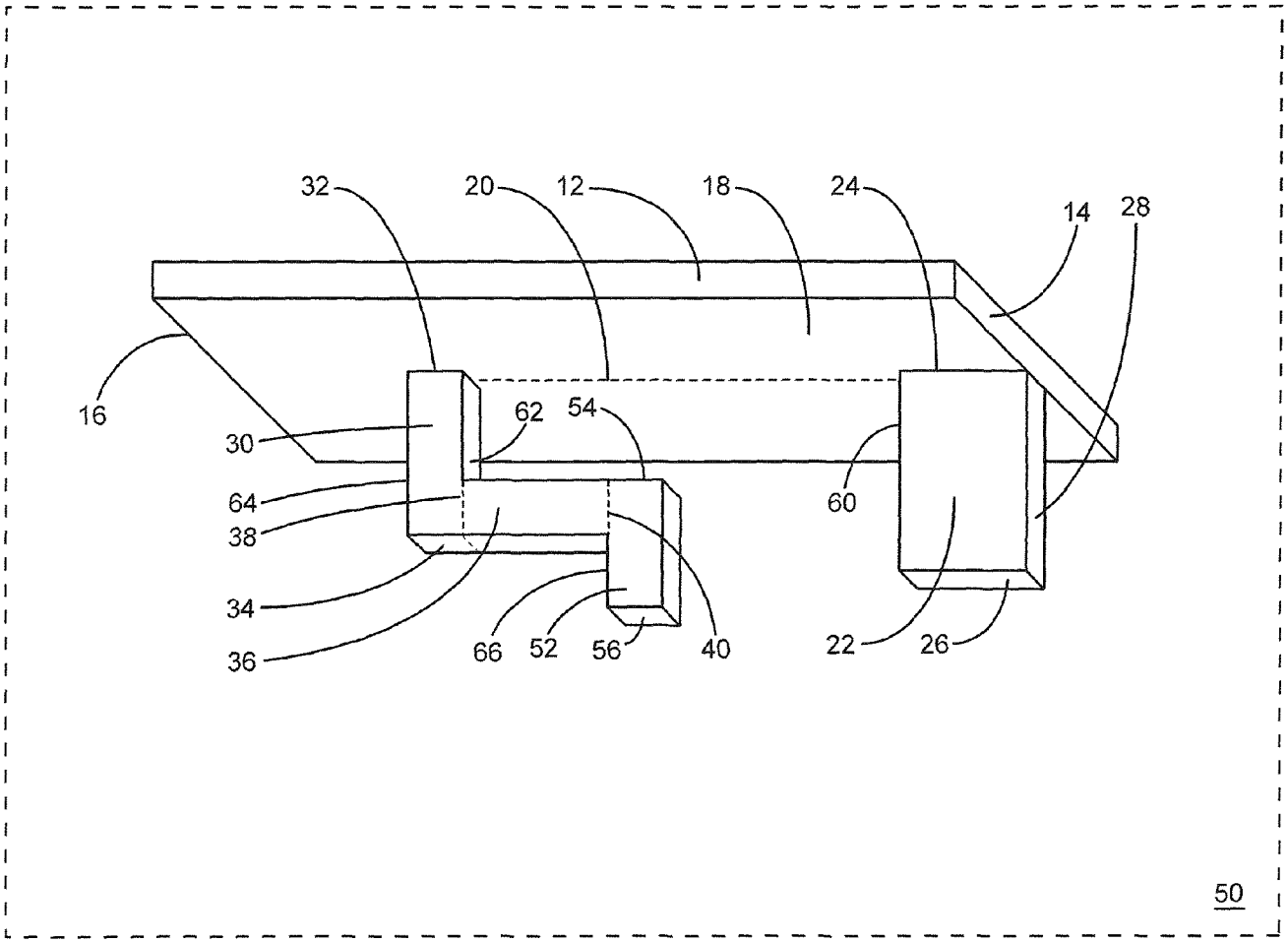

FIG. 7 shows a three-dimensional view from one side and underneath the dual band RF antenna structure according to an alternate embodiment of the dual band RF antenna structure.

Figure 8:
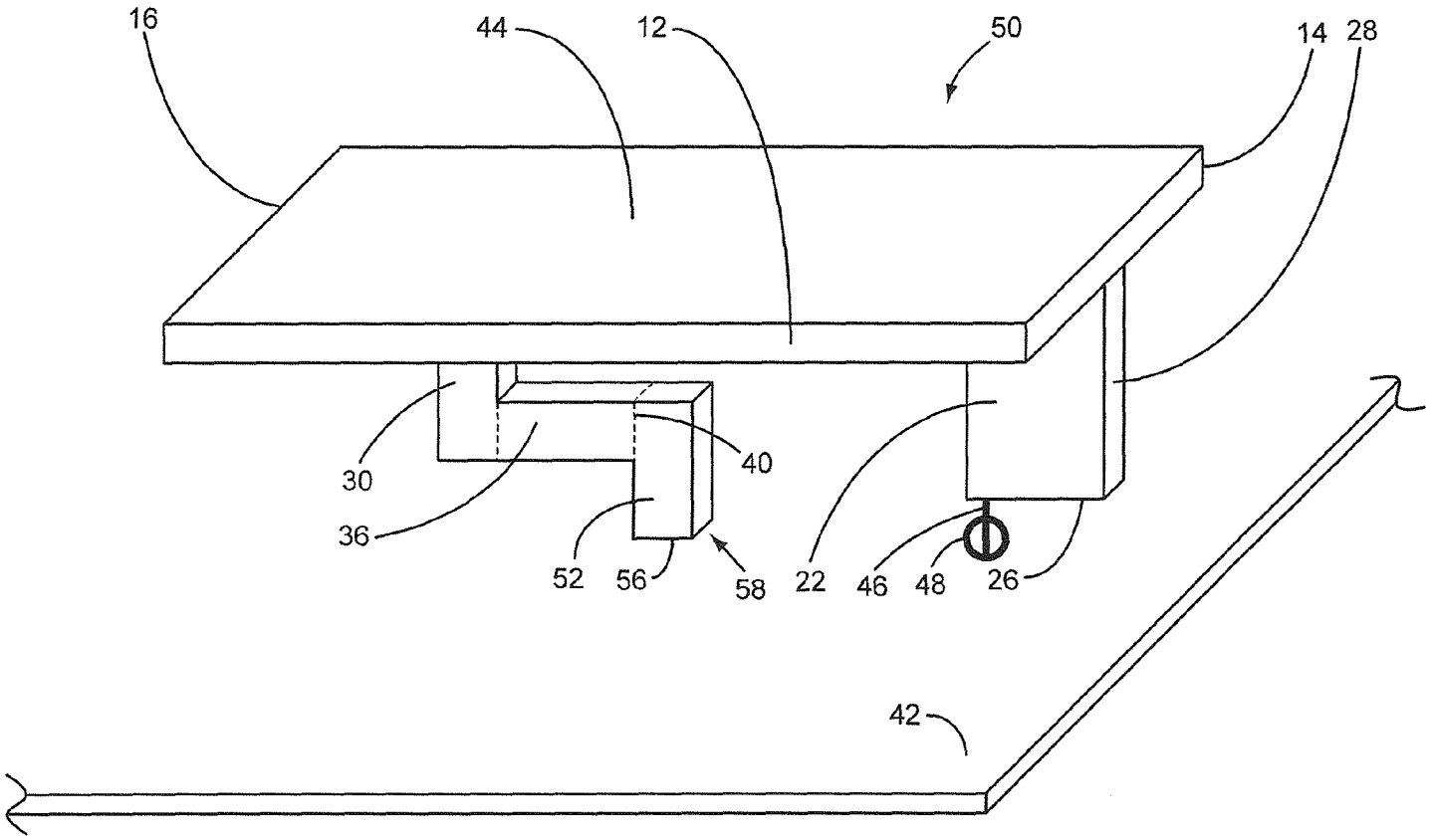

FIG. 8 shows a three-dimensional view from one side and above the dual band RF antenna structure illustrated in FIG. 7.

Figure 9:
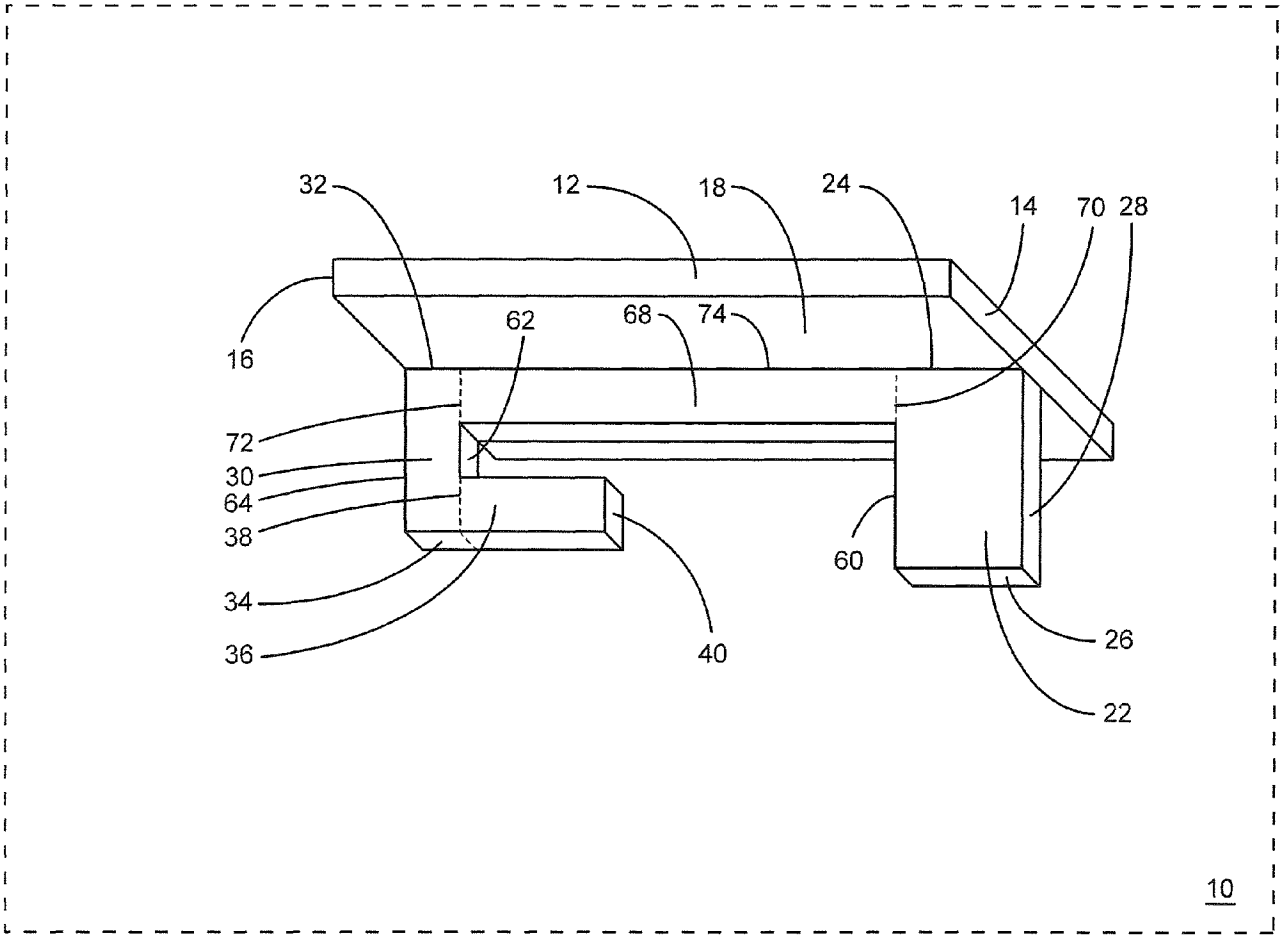

FIG. 9 shows as three-dimensional view from one side and underneath the RF antenna structure according to an additional embodiment of the RF antenna structure.

Figure 10:
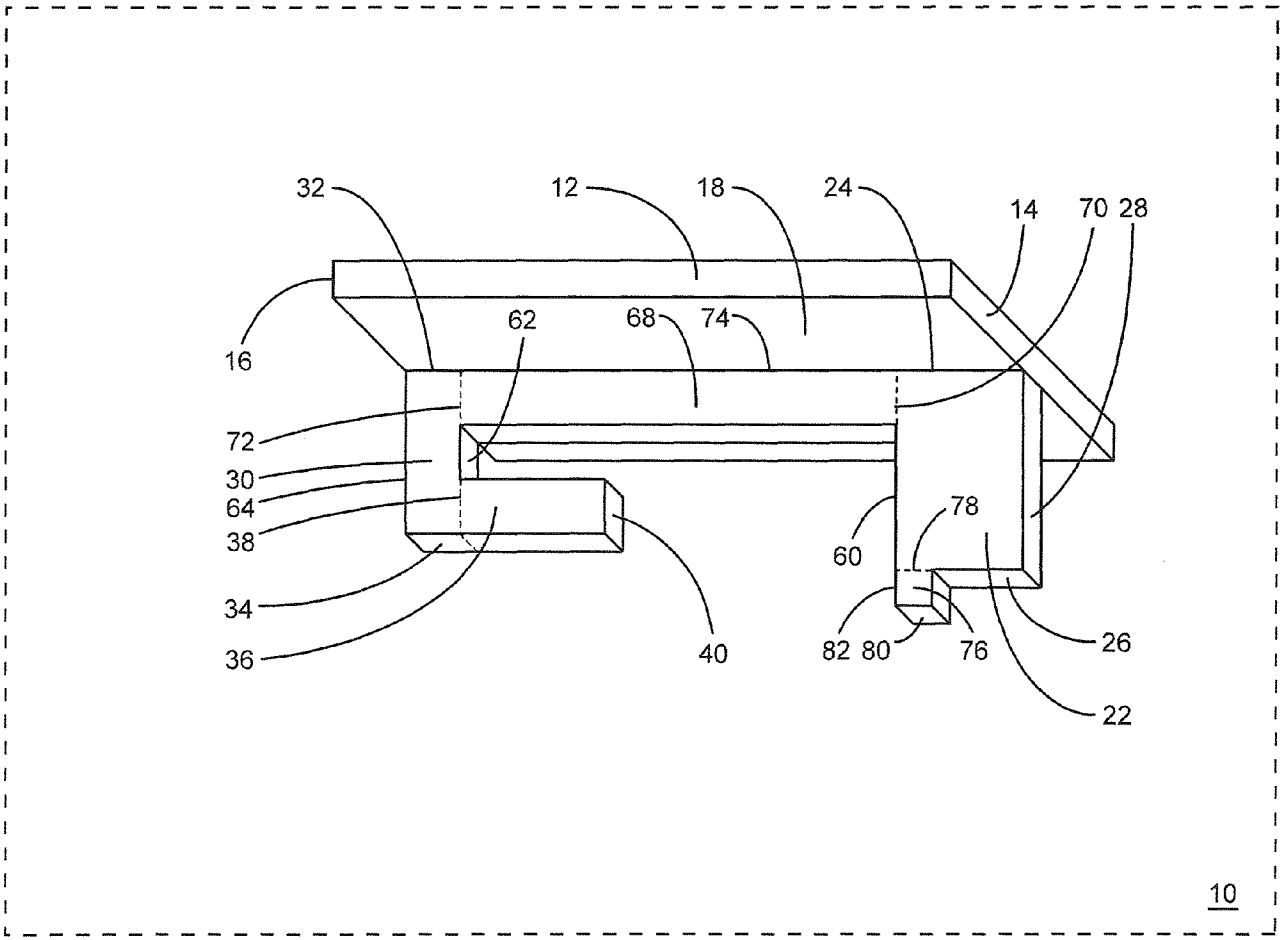

FIG. 10 shows a three-dimensional view from one side and underneath the RF antenna structure according to another embodiment of the RF antenna structure.

Figure 11:
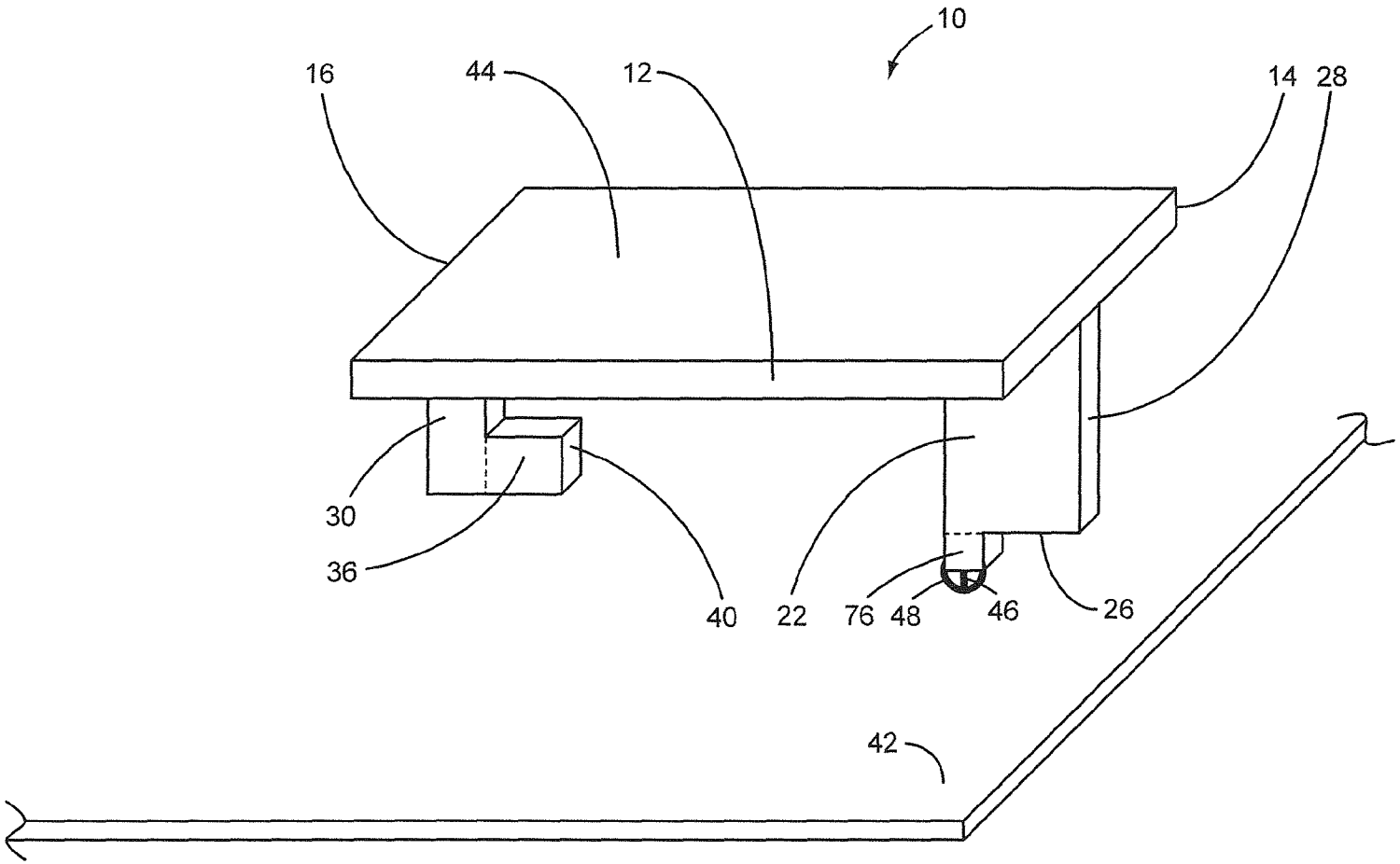

FIG. 11 shows a three-dimensional view from one side and above the RF antenna structure illustrated in FIG. 10.

Figure 12:
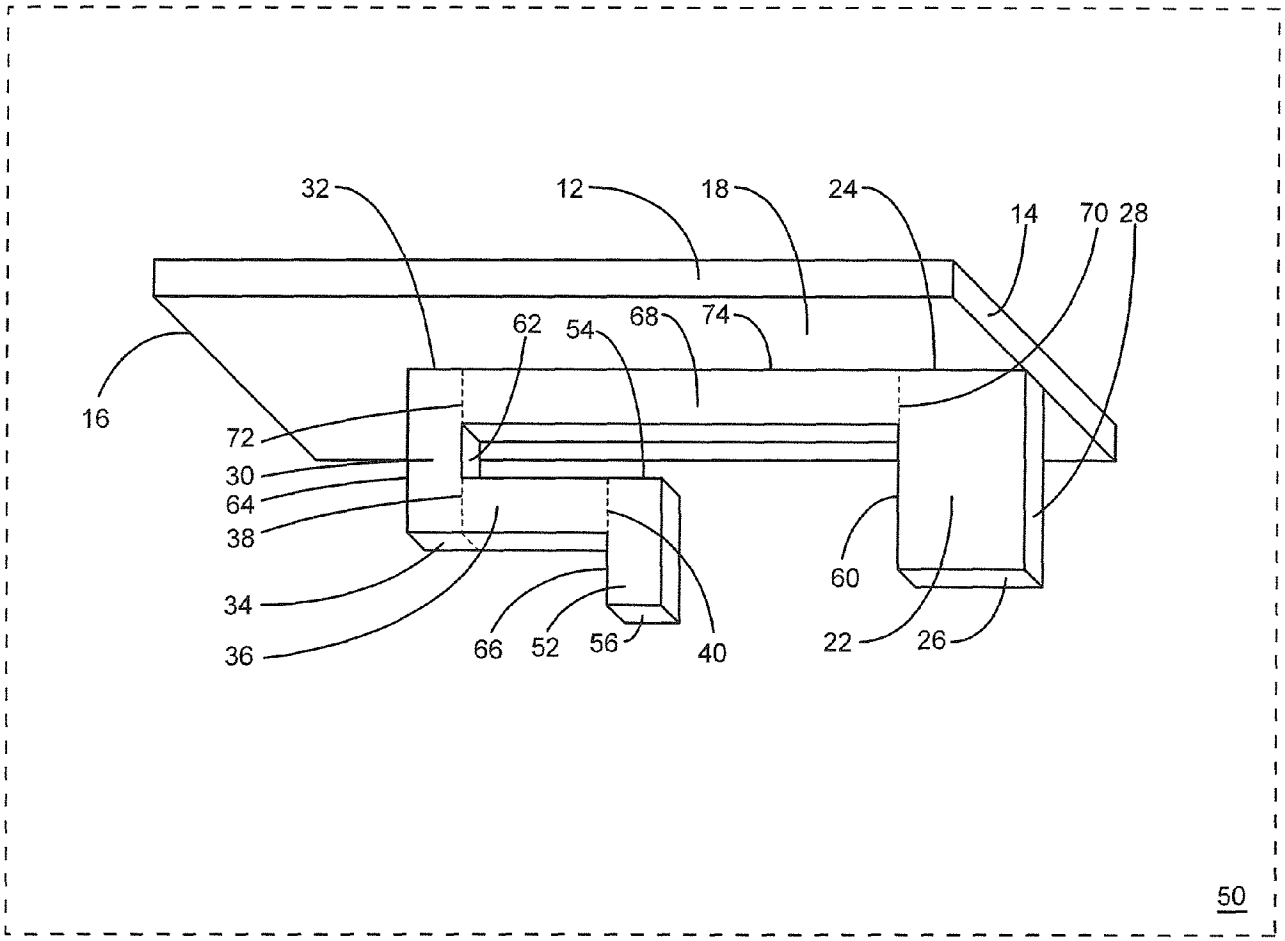

FIG. 12 shows a three-dimensional view from one side and underneath the dual band RF antenna structure according to an additional embodiment of the dual band RF antenna structure.

Figure 13:
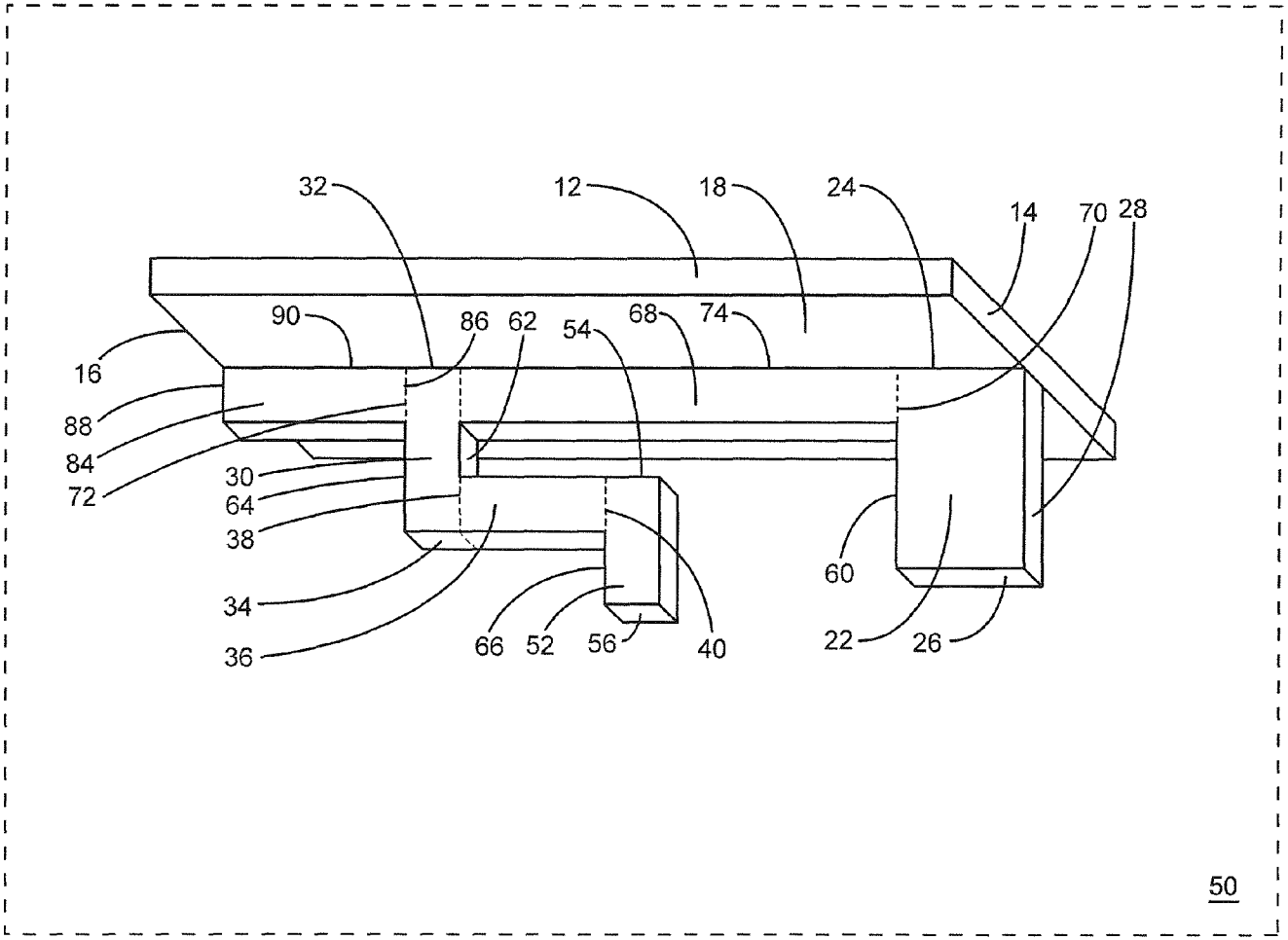

FIG. 13 shows a three-dimensional view from one side and underneath the dual band RF antenna structure according to another embodiment of the dual band RF antenna structure.

Figure 14:
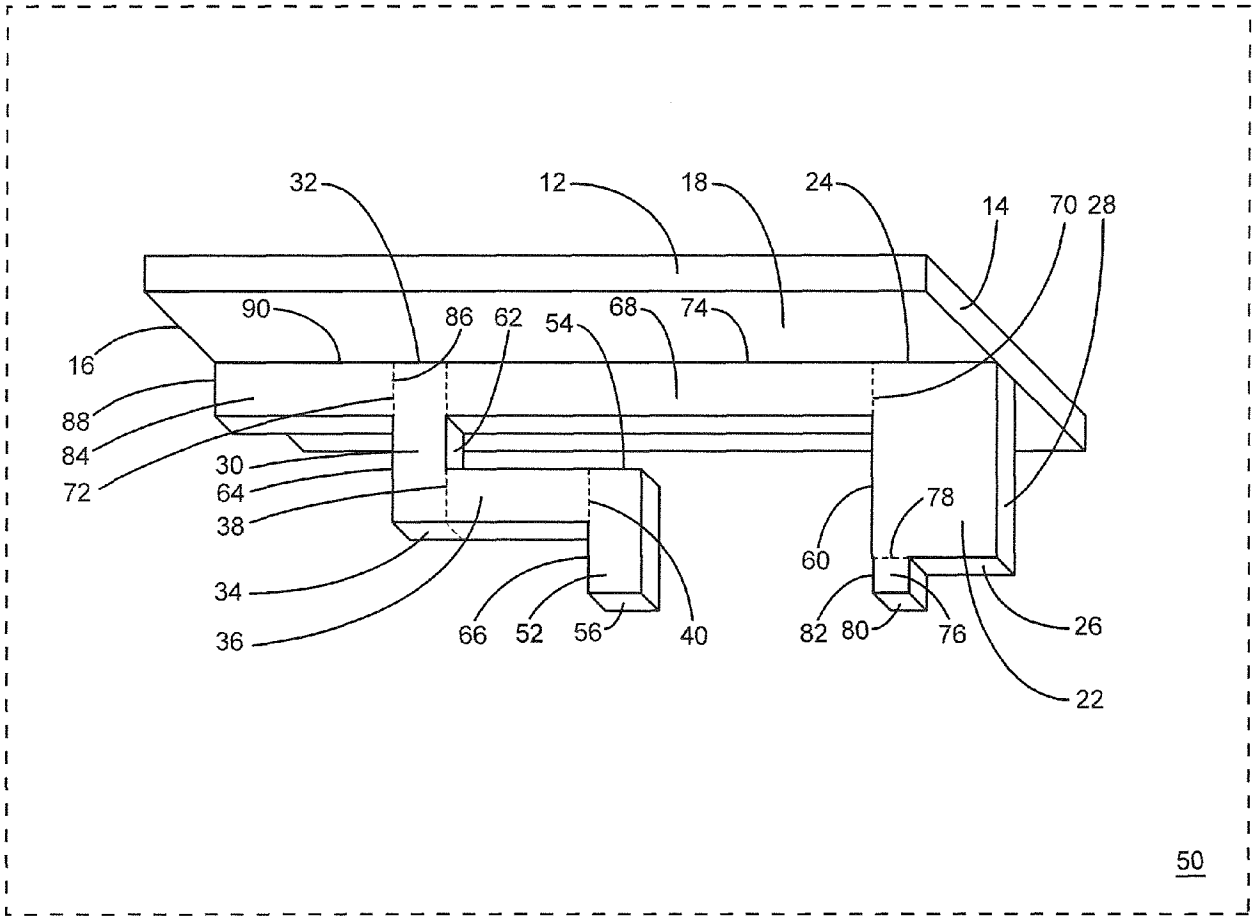

FIG. 14 shows a three-dimensional view from one side and underneath the dual band RF antenna structure according to a supplemental embodiment of the dual band RF antenna structure.

Figure 15:
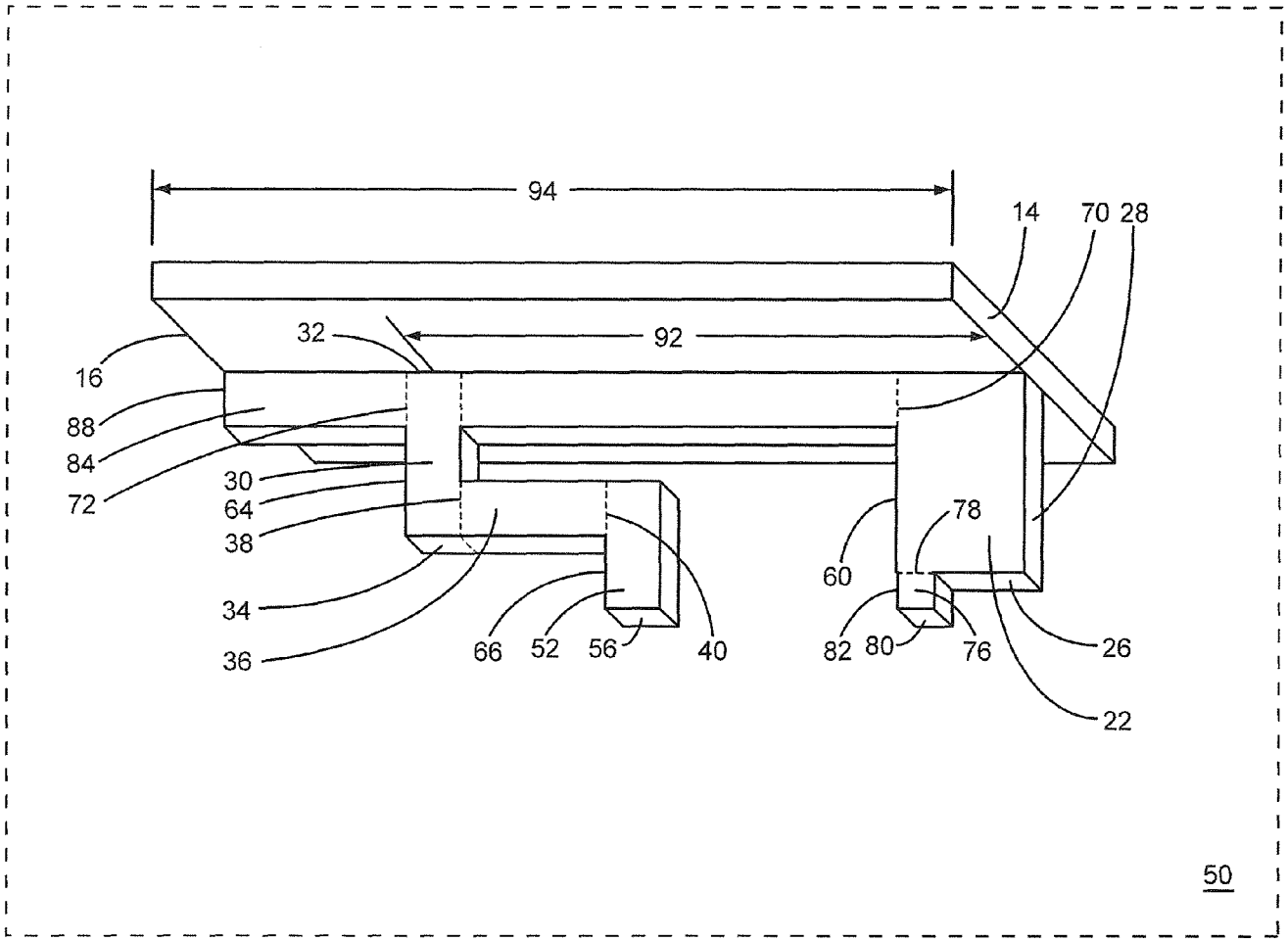

FIG. 15 shows details of the dual band RF antenna structure illustrated in FIG. 14.

Figure 1:
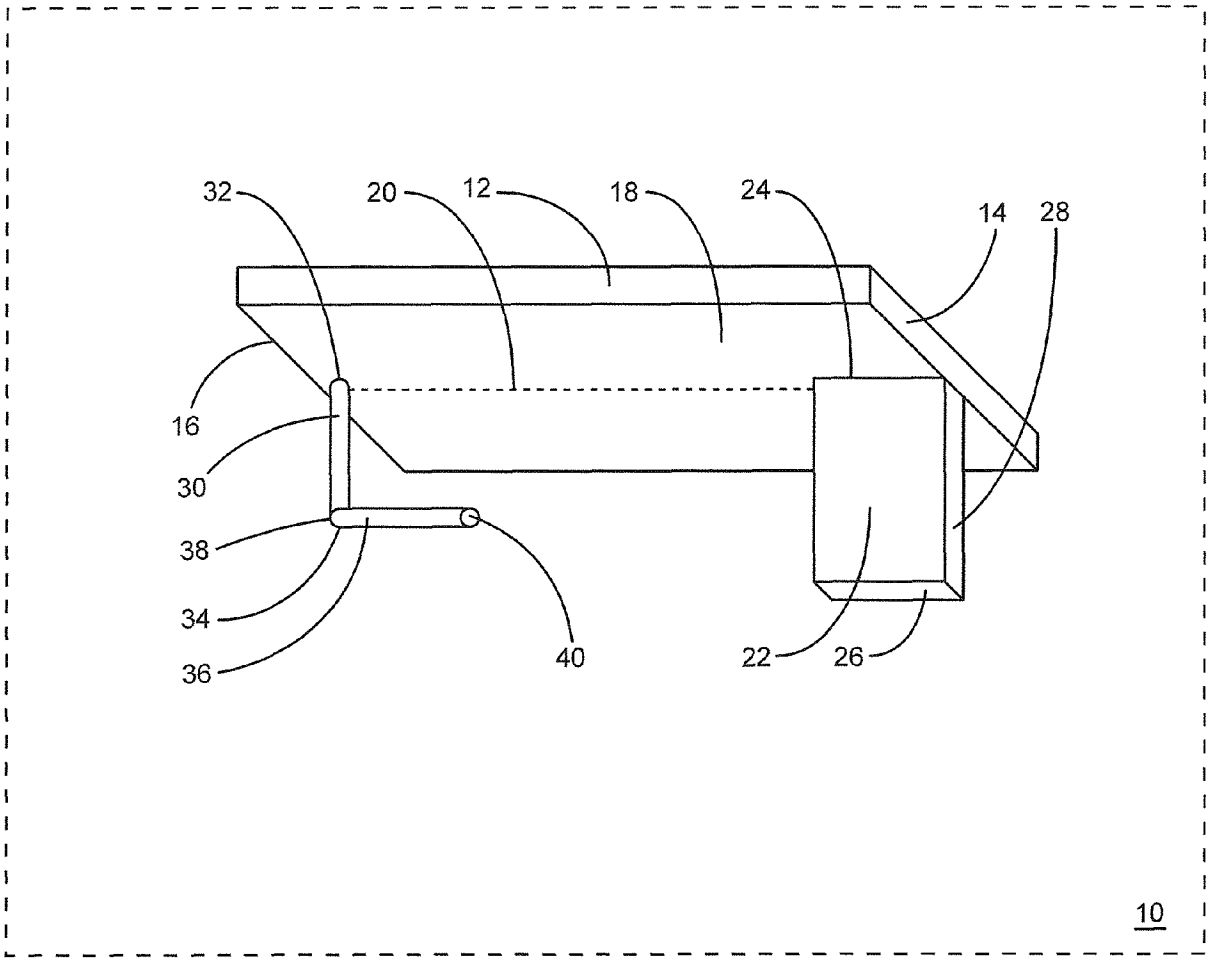
FIG. 1 shows a three-dimensional view from one side and underneath an RF antenna structure according to one embodiment of the present invention.
Figure 16:
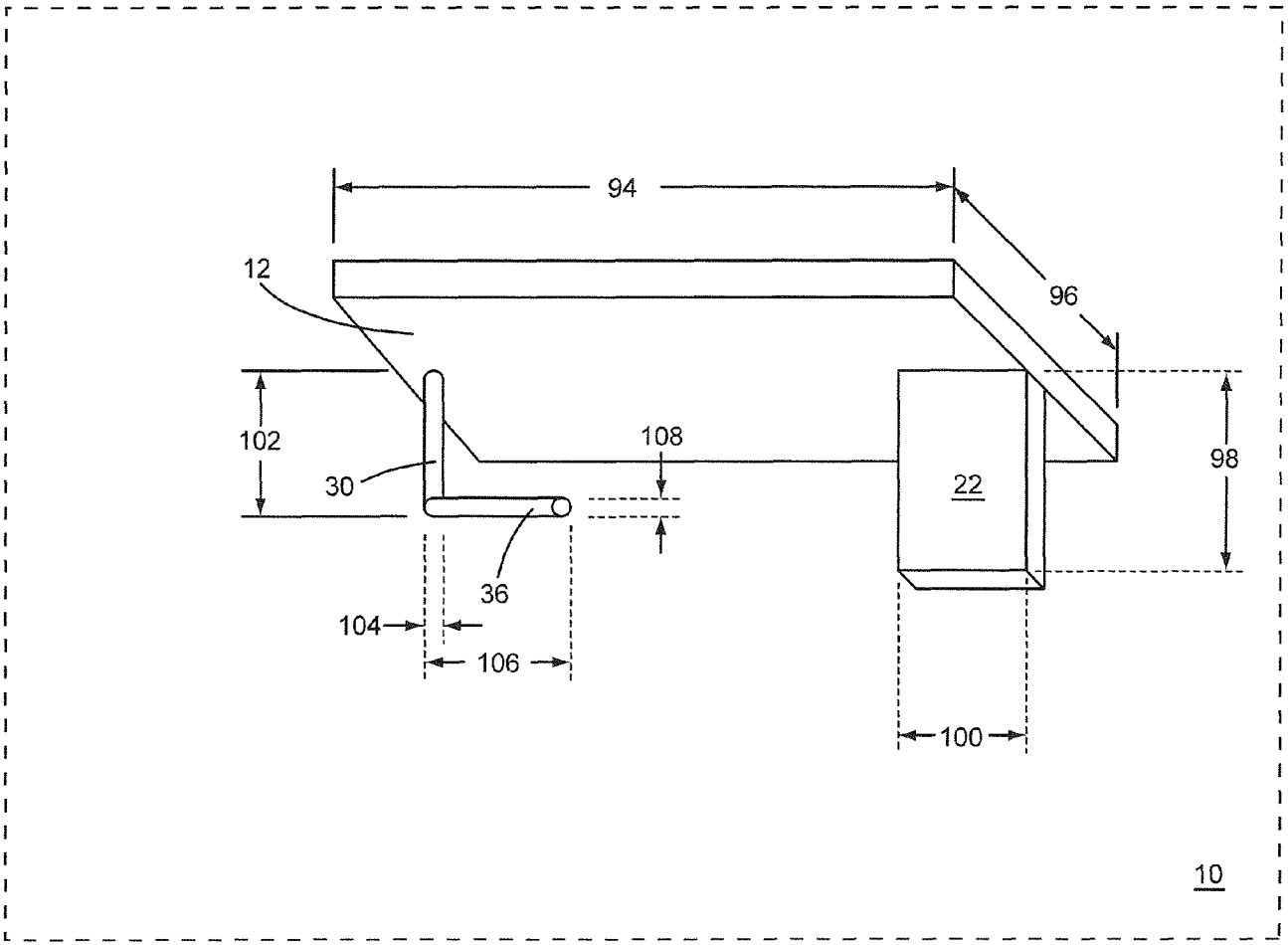

FIG. 16 shows details of the RF antenna structure illustrated in FIG. 1.

Figure 17:
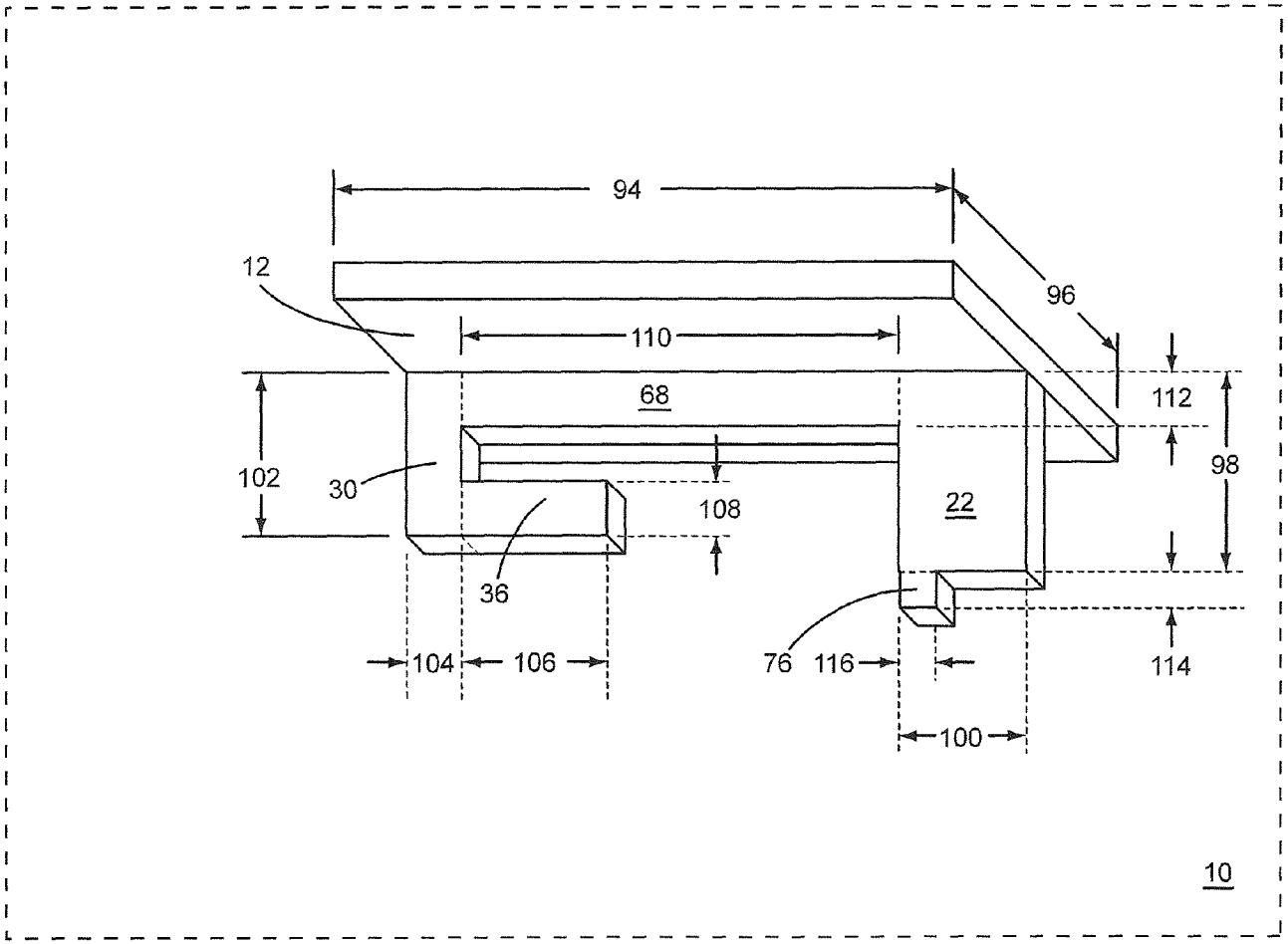

FIG. 17 shows details of the RF antenna structure illustrated in FIG. 10.

Figure 18:
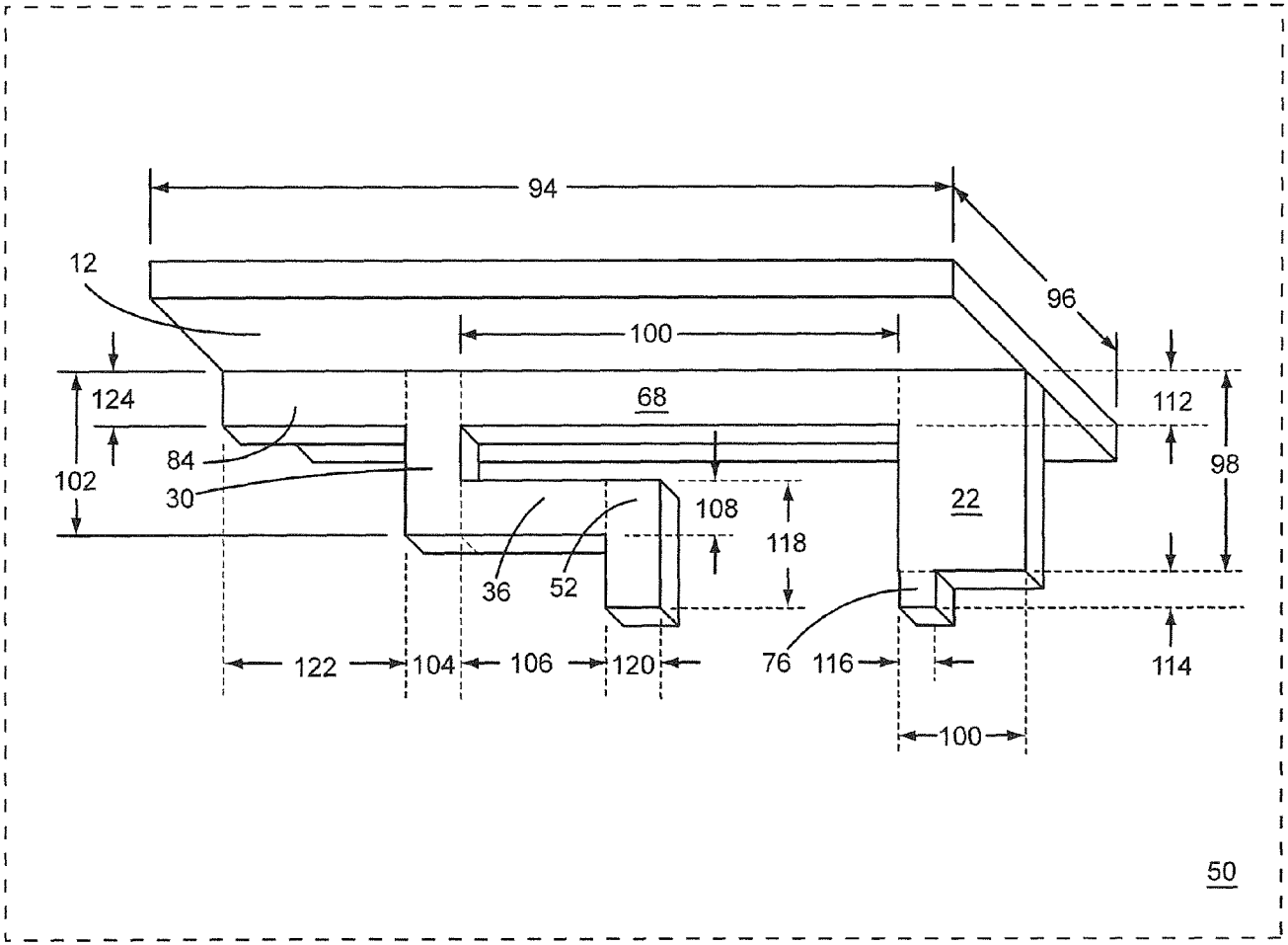

FIG. 18 shows additional details of the dual band RF antenna structure illustrated in FIG. 14.

Figure 19:
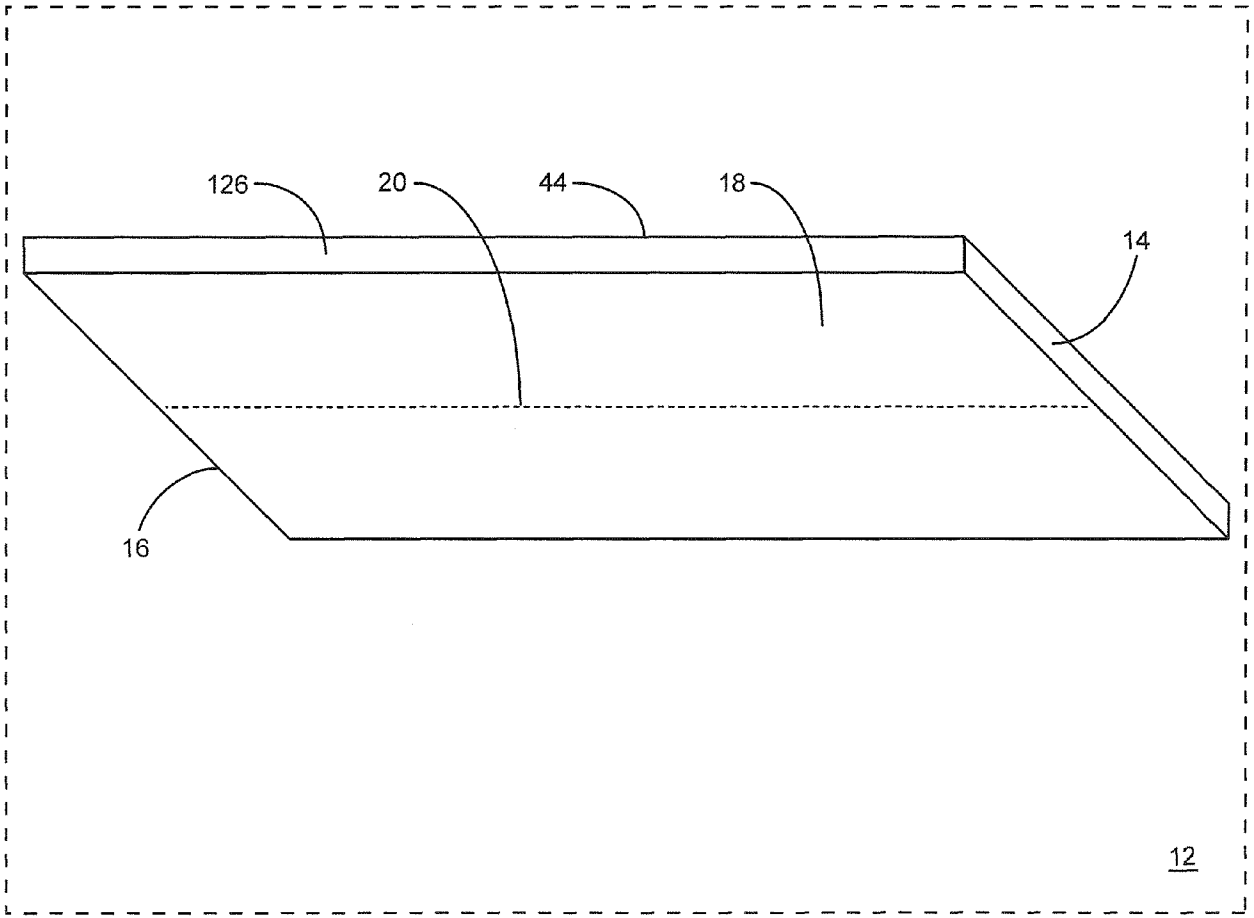

FIG. 19 shows a loading plate according to a first embodiment of the loading plate.

Figure 20:
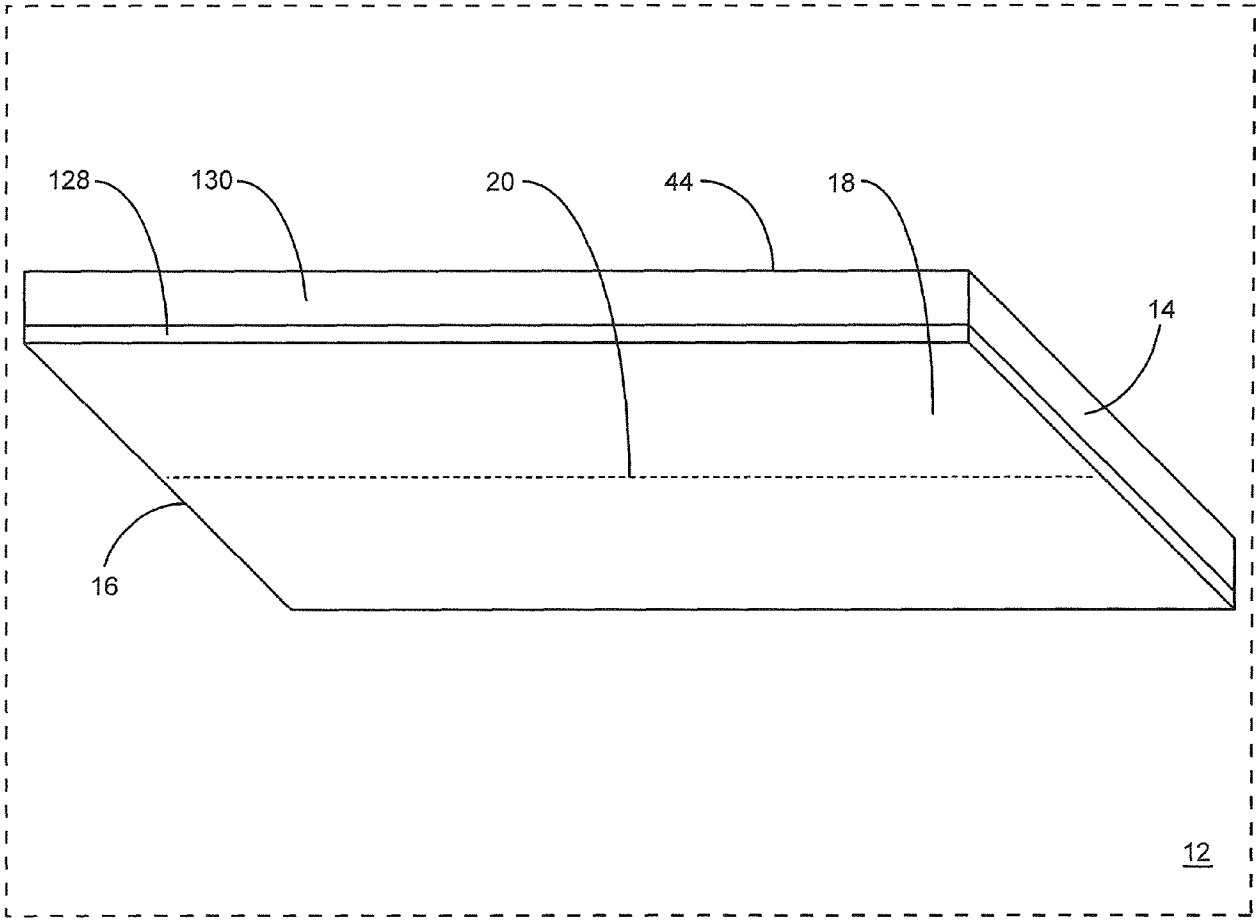

FIG. 20 shows the loading plate according to a second embodiment of the loading plate.

Figure 21:
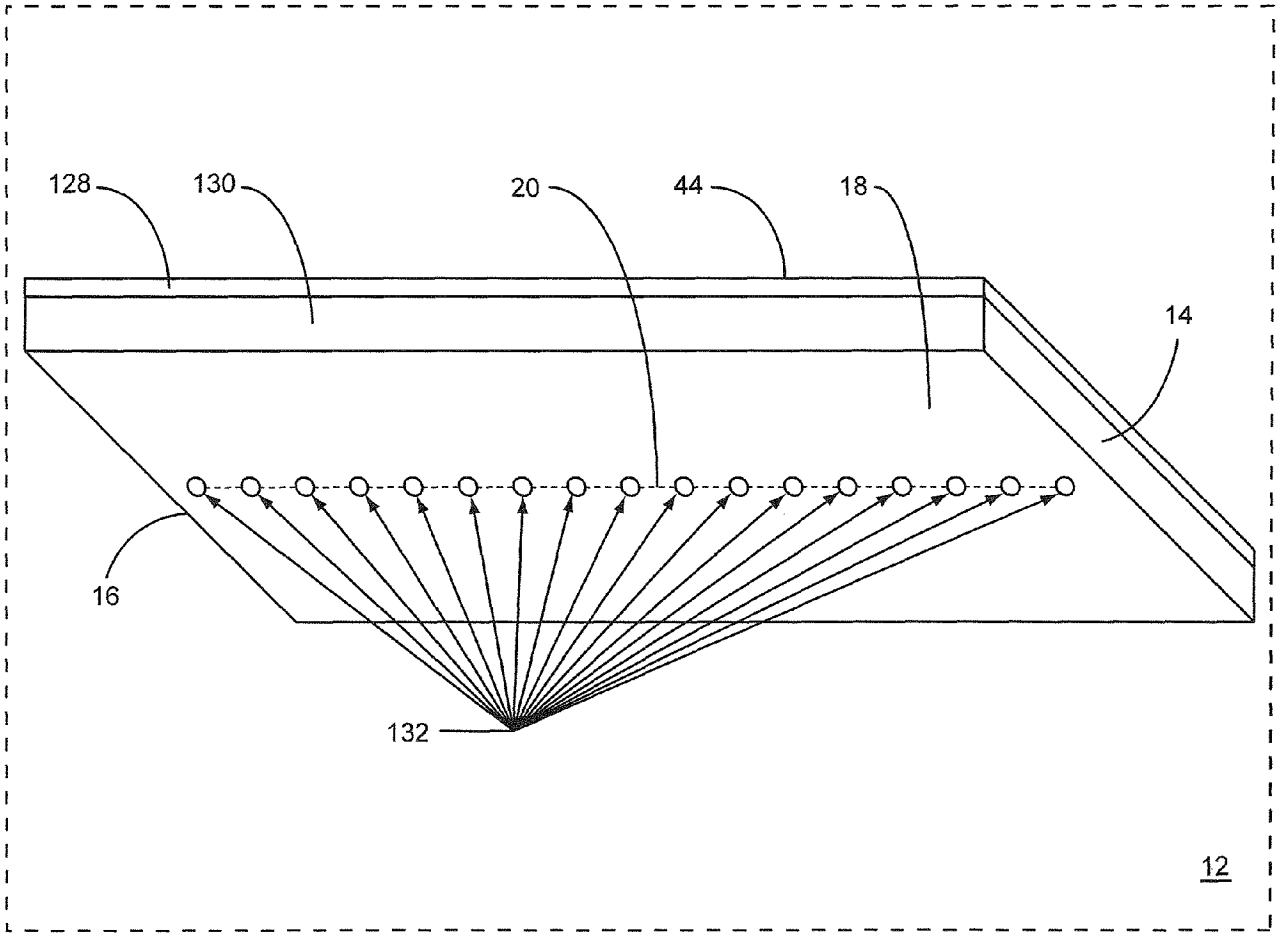

FIG. 21 shows the loading plate according to a third embodiment of the loading plate.

Figure 22:
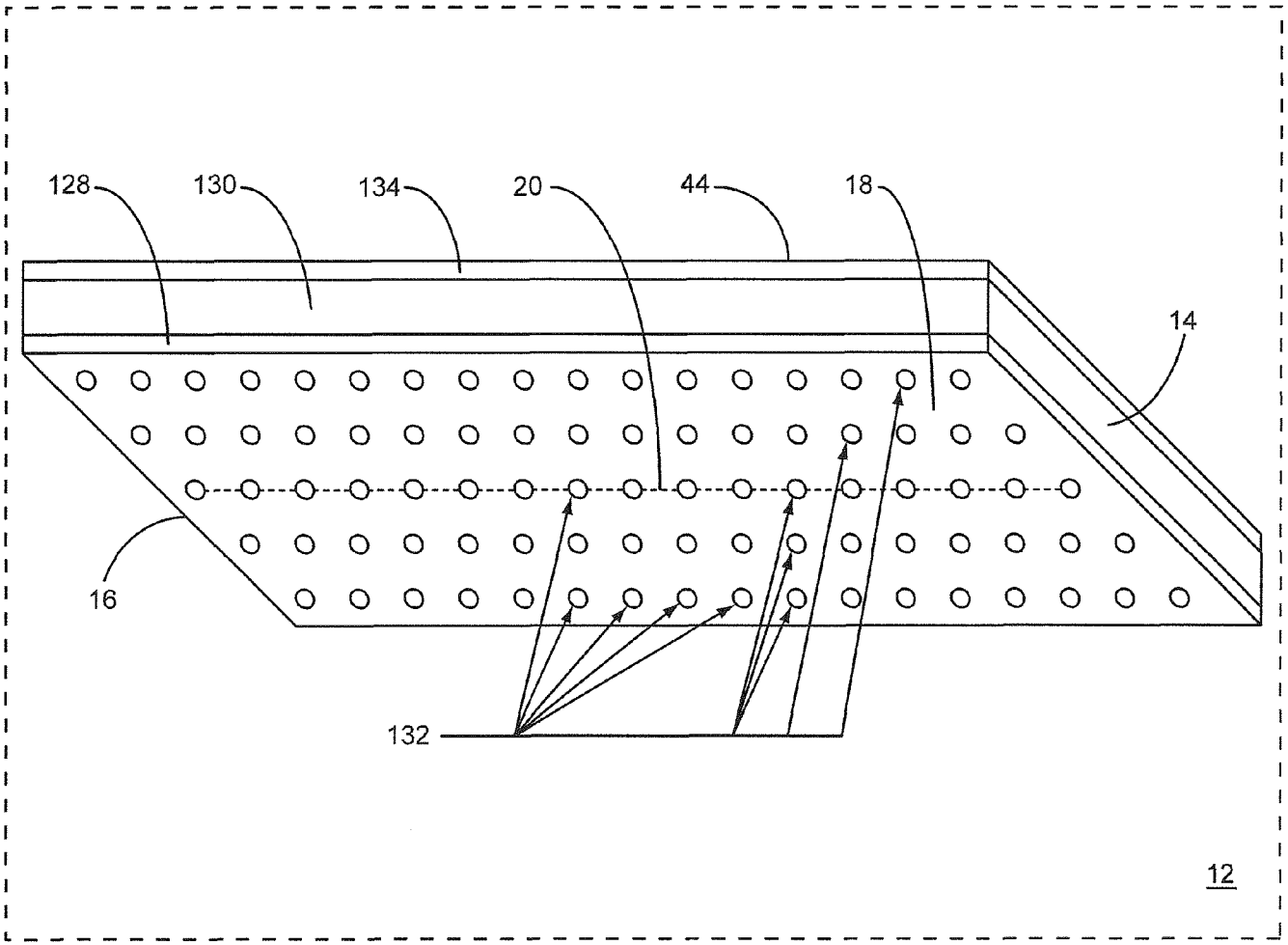

FIG. 22 shows the loading plate according to a fourth embodiment of the loading plate.

Figure 23:
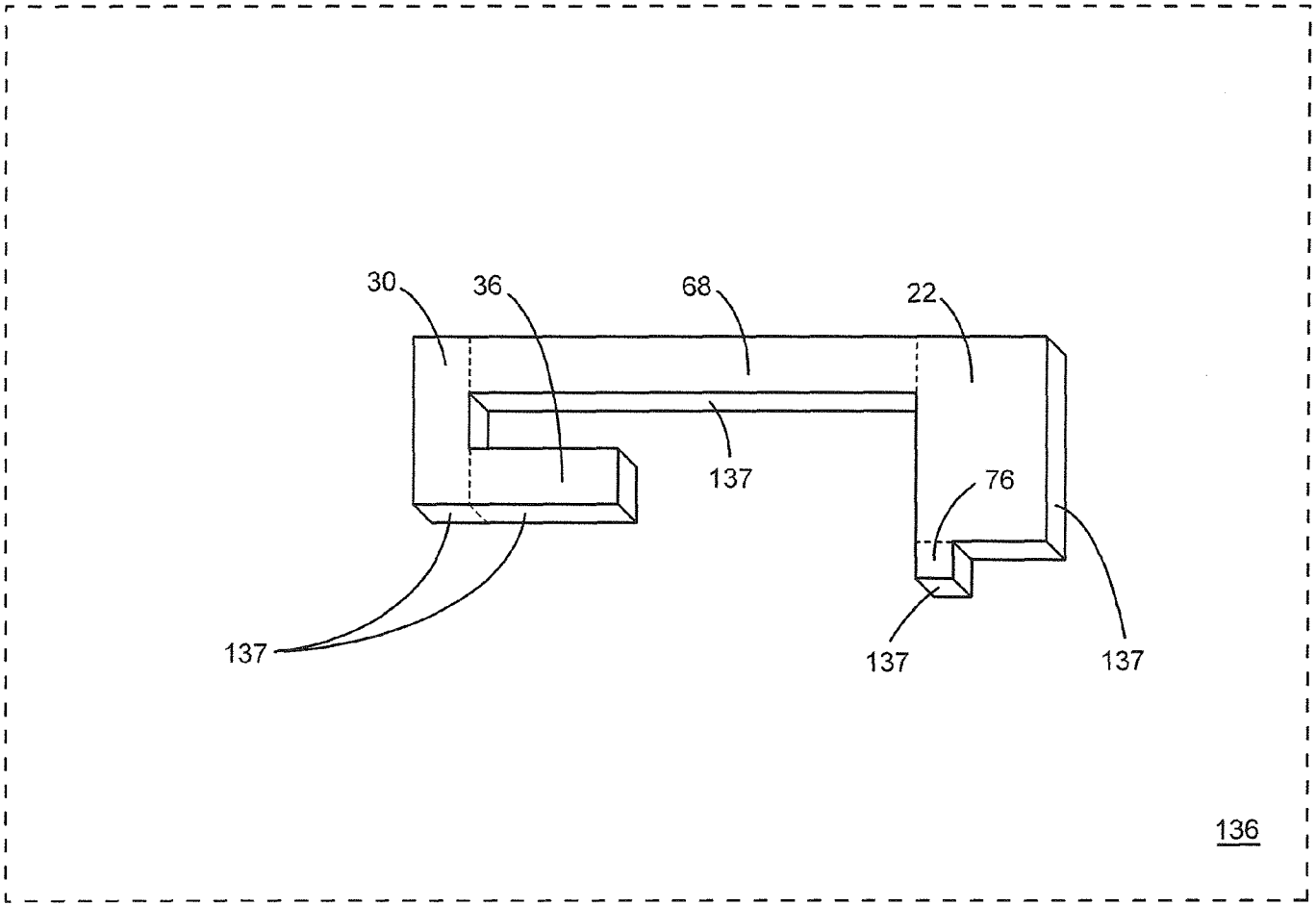

FIG. 23 shows a planar structure, which may be used in the RF antenna structure illustrated in FIG. 10 according to a first embodiment of the planar structure.

Figure 24:
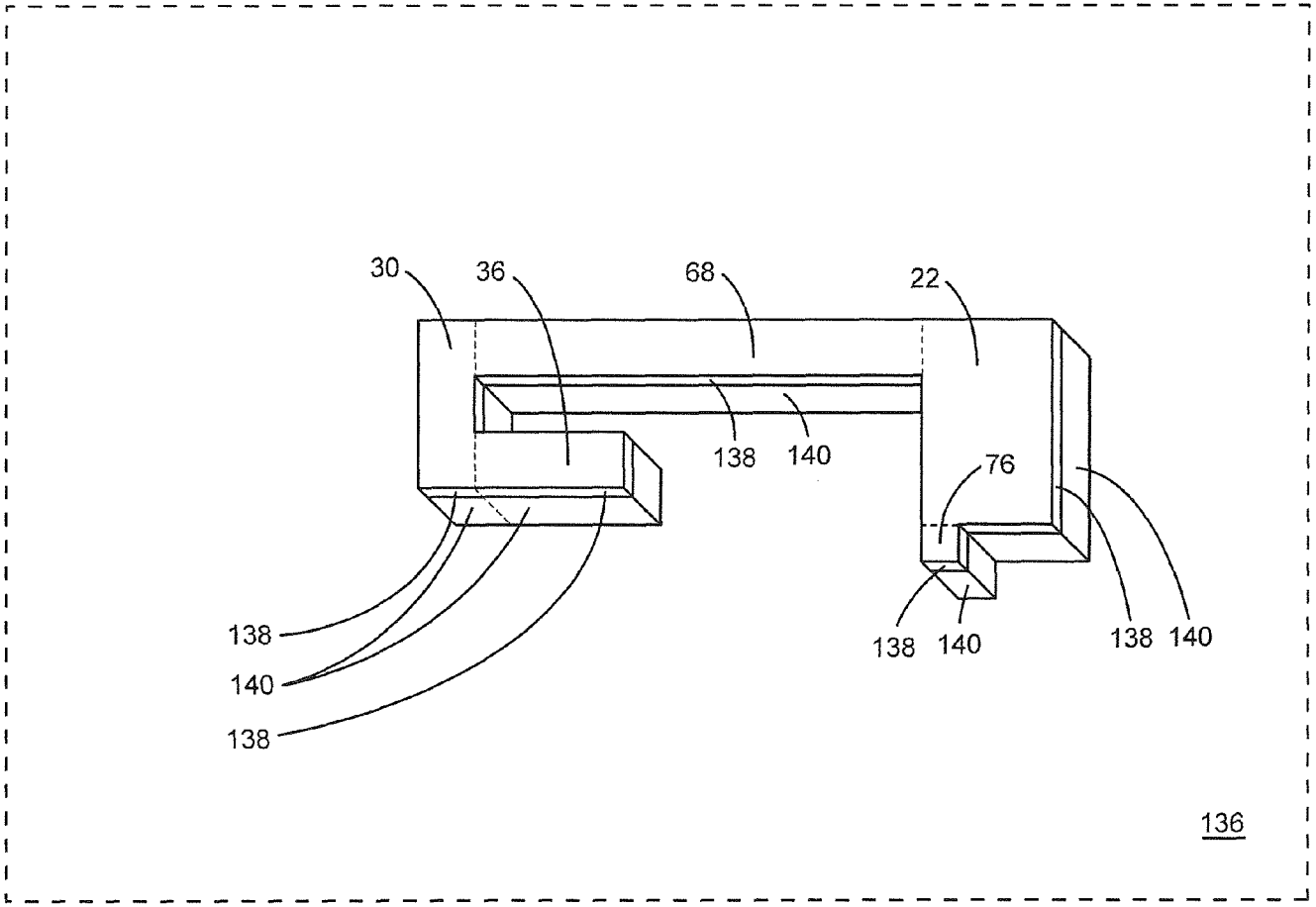

FIG. 24 shows the planar structure, which may be used in the RF antenna structure illustrated in FIG. 10 according to a second embodiment of the planar structure.

Figure 25:
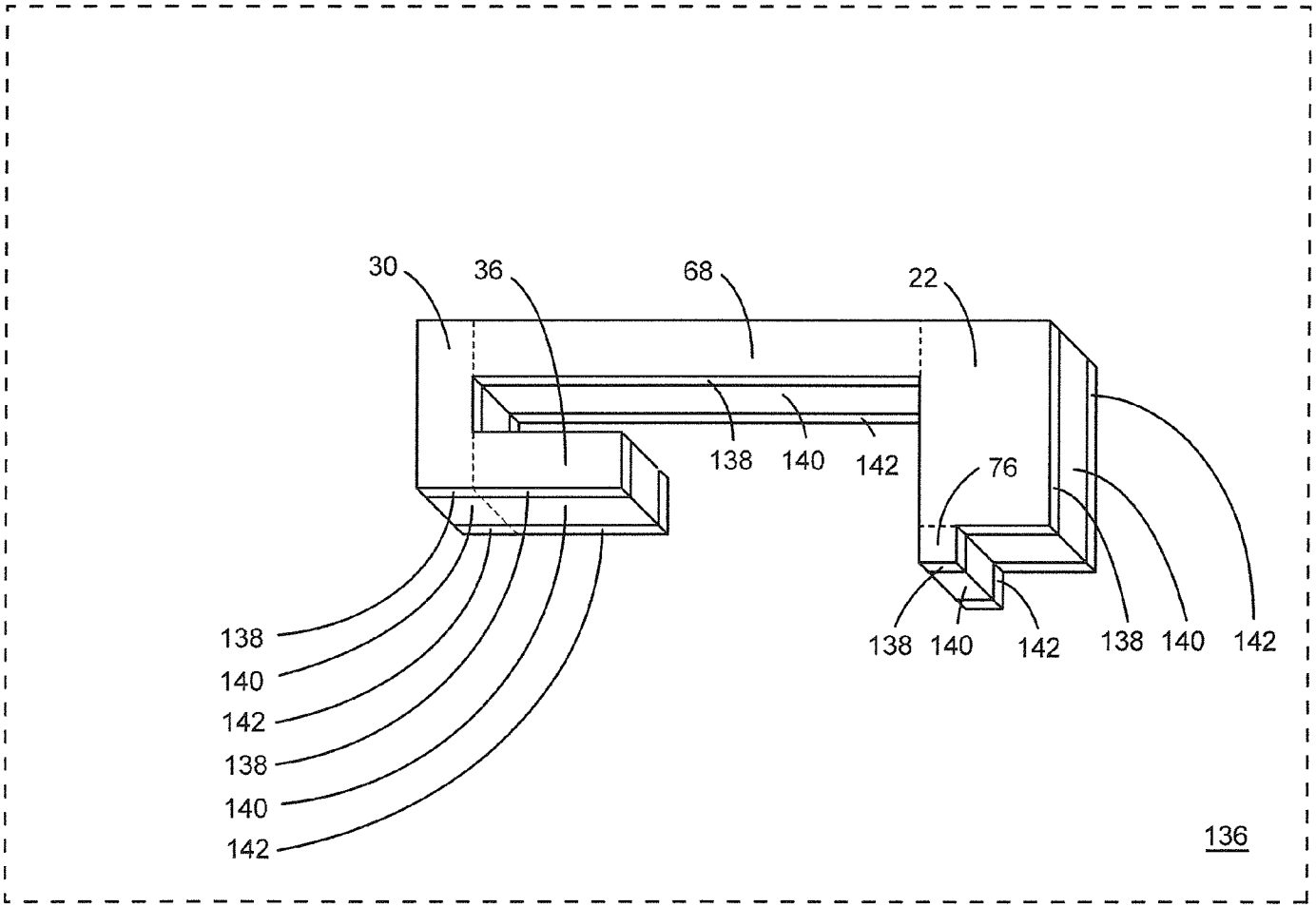

FIG. 25 shows the planar structure, which may be used in the RF antenna structure illustrated in FIG. 10 according to a third embodiment of the planar structure.

Figure 26:
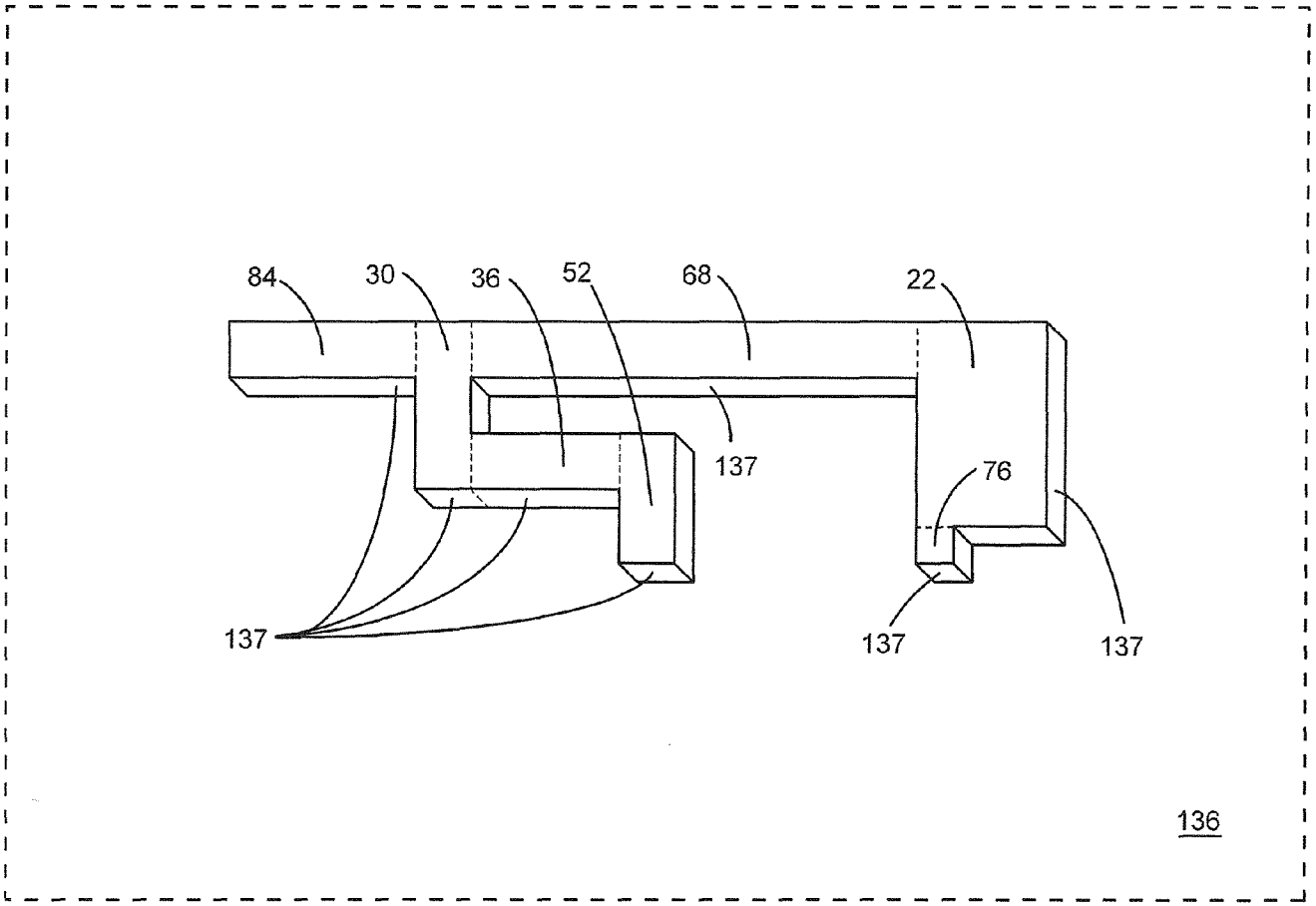

FIG. 26 shows the planar structure, which may be used in the dual band RF antenna structure illustrated in FIG. 14 according to a fourth embodiment of the planar structure.

Figure 27:
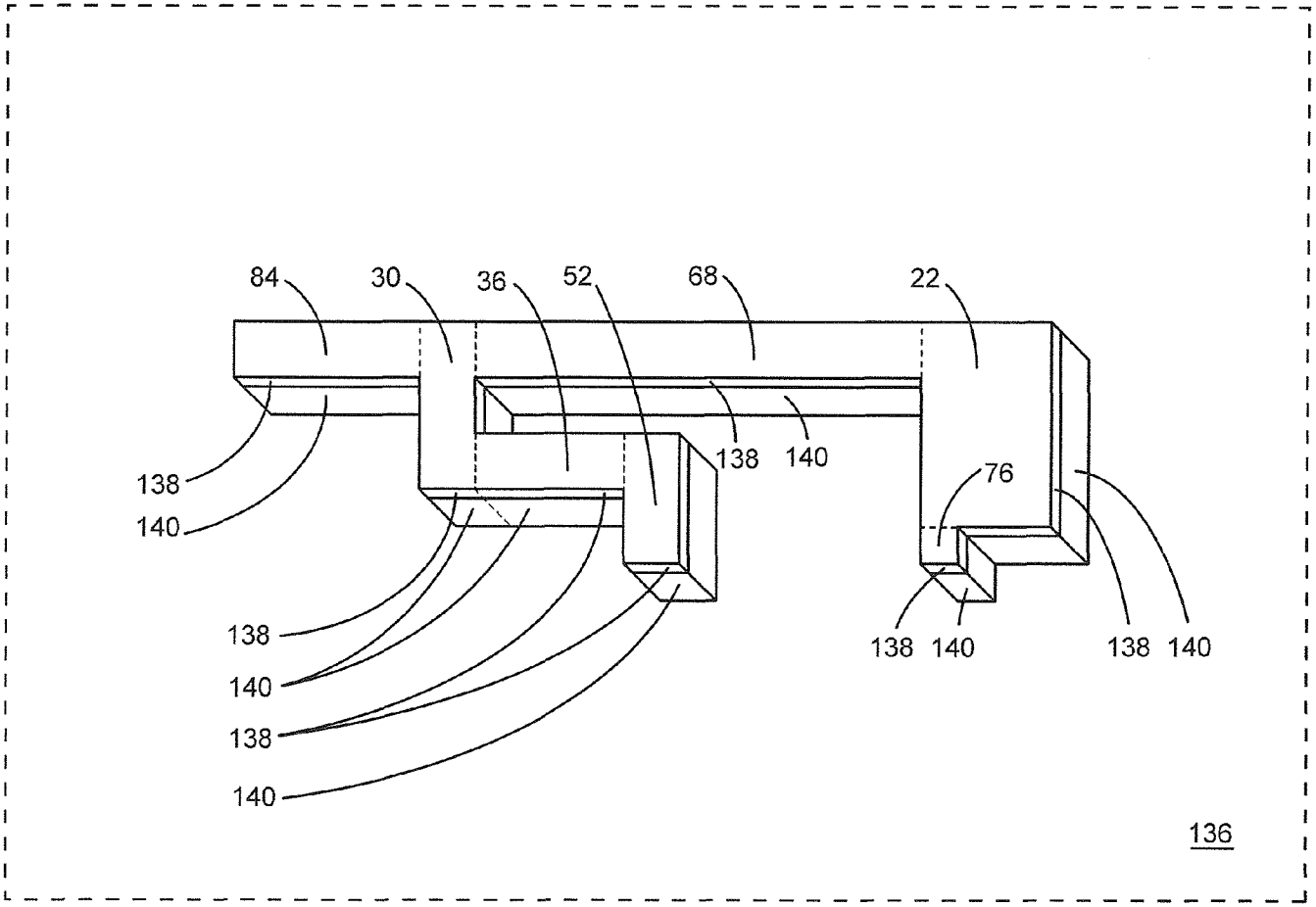

FIG. 27 shows the planer structure, which may be used in the dual band RF antenna structure illustrated in FIG. 14 according to a fifth embodiment of the planar structure.

Figure 28:
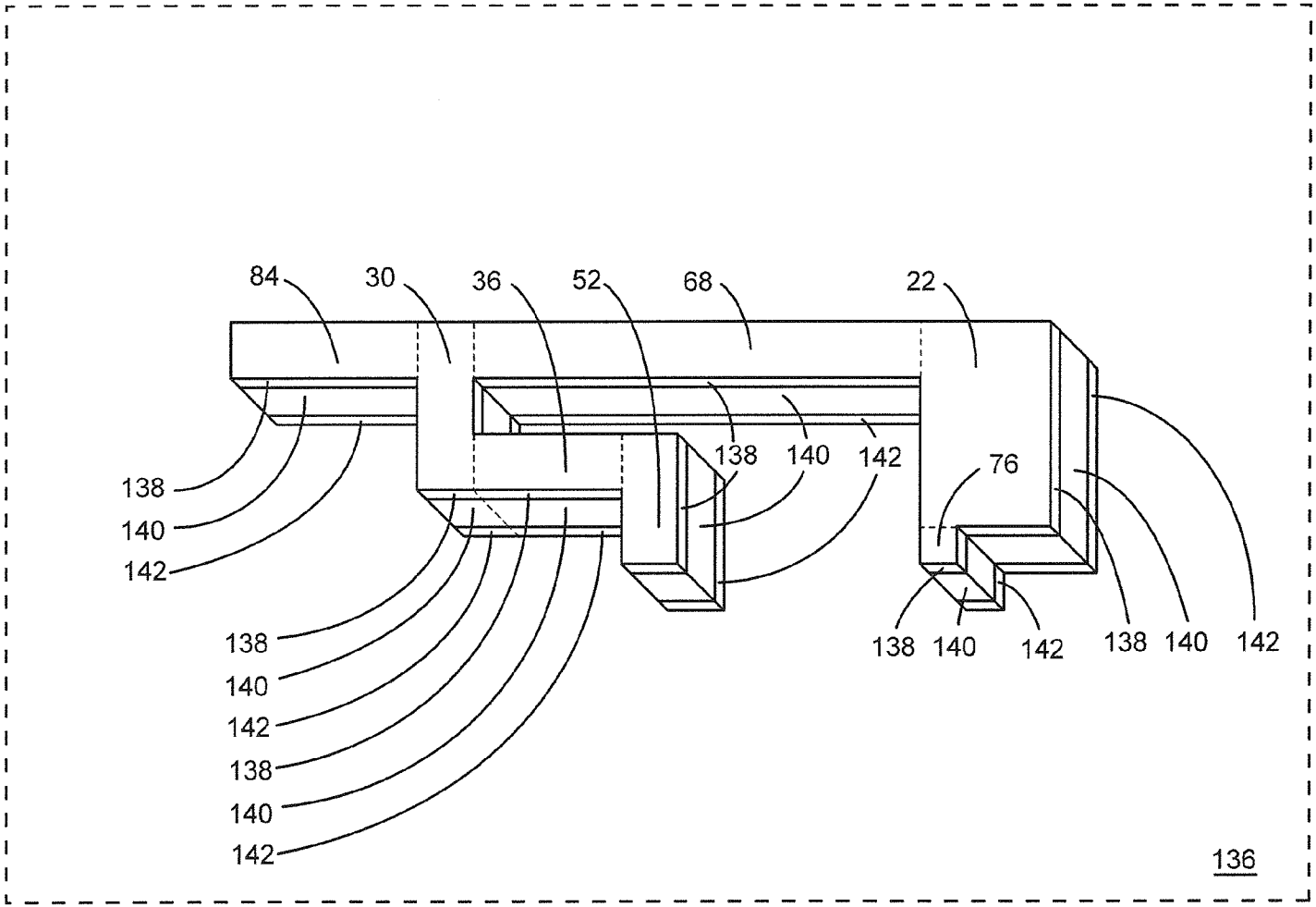

FIG. 28 shows the planar structure, which may be used in the dual band RF antenna structure illustrated in FIG. 14 according to a sixth embodiment of the planar structure.

Figure 29:
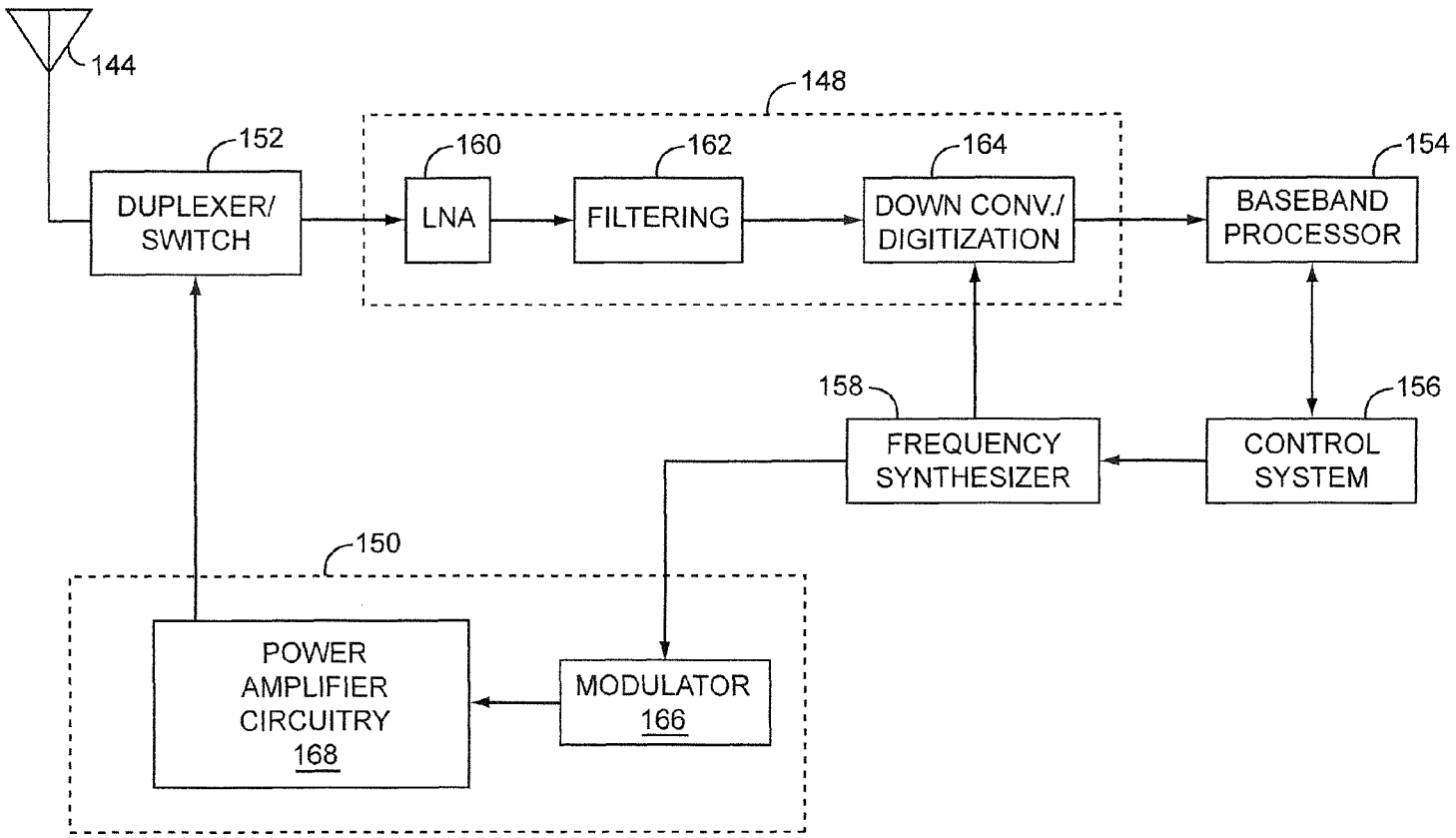

FIG. 29 shows an application example of the present invention used in a wireless local area network (WLAN) access paint.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description in light of the accompanying drawing figures, those skilled in the art wilt understand the concepts of the invention and will recognize applications of these concepts not particularly addressed herein. It should be understood that these concepts and applications fall within the scope of the disclosure and the accompanying claims.

The present invention relates to an RF antenna structure that includes a planar structure and a loading plate, such that the planar structure is mounted between a ground plane and the loading plate to form an RF antenna. The loading plate may be about parallel to the ground plane and the planar structure may be about perpendicular to the loading plate and the ground plane. The loading plate may allow the height of the RF antenna structure above the ground plane to be relatively small. For example, the height may be significantly less than one-quarter of a wavelength of RF signals of interest. The planer structure may include two conductive matching elements to help increase the bandwidth of the RF antenna structure. In one embodiment of the present invention, the bandwidth of the RF antenna may be greater than about 15 percent of the center frequency of a communications band of interest.

All or part of the RF antenna structure may include metal rods, stamped metal, printed circuits, or any combination thereof. In one embodiment of the present invention, the RF antenna is a single band RF antenna. In an alternate embodiment of the present invention, the RF antenna is a dual band RF antenna. The RF antenna may be used in a wireless local area network (WLAN) access point. The WLAN access point may be a multiple-input multiple-output (MIMO) WLAN access point, in which case the MIMO WLAN access point will include two or more RF antenna elements. The WLAN access point may operate using the IEEE 802.11n wireless communications standard an may utilize the 2.4 gigahertz (GHz) to 2.4835 GHz communications band, the 4.9 GHz and 5.825 GHz communications band, or both.

FIG. 1 shows a three-dimensional view from one side and underneath an RF antenna structure 10 according to one embodiment of the present invention. The RF antenna structure 10 includes a loading plate 12, which has a first end 14, a second end 16, a first planar surface 18, and a lengthwise centerline 20 that longitudinally divides the first planar surface 18 into about equal halves. The loading plate 12 may be flat having sides and ends of any shape. In one embodiment, the loading plate 12 is flat and about rectangular. Additionally, the RF antenna structure 10 includes a first conductive matching element 22, which has a third end 24, a fourth end 26, and a first edge 28, a first conductive element 30, which has a fifth end 32 and a sixth end 34, and a second conductive matching element 36, which has a seventh end 38 and an eighth end 40. In one embodiment of the loading plate 12, the first planar surface 18 provides a first planer conductive surface. In one embodiment of the loading plate 12, the first planar conductive surface is about rectangular.

The first conductive matching element 22, the first conductive element 30, and the second conductive matching element 36 may form a planar structure. which is about perpendicular to the first planar conductive surface. The third end 24 may be adjacent to the first planar surface 18 and may be electrically connected to the first planar conductive surface. Additionally, the third end 24 may be biased toward the first end 14. In one embodiment of the first conductive matching element 22, the first edge 28 may be about flush with the first end 14, at least a portion of the third end 24 may contact a portion of the first planar surface 18, at least a portion of the third end 24 may contact the first planar conductive surface along the lengthwise centerline 20 of the first planar surface 18, or any combination thereof. The first edge 28 may be about perpendicular to the first planar conductive surface.

The first conductive matching element 22 may be flat having sides and ends of any shape. In one embodiment, the first conductive matching element 22 is flat and about rectangular, as shown. The first conductive element 30 may be of any shape. In one embodiment, the first conductive element 30 is about cylindrically shaped, as shown. The first conductive element 30 may be formed from a metallic rod. In an alternate embodiment, the first conductive element 30 is flat and about rectangular. The second conductive matching element 36 may be of any shape. In one embodiment, the second conductive matching element 36 is about cylindrically shaped, as shown. The second conductive matching element 36 may be formed from a metallic rod. In an alternate embodiment, the second conductive matching element 36 is flat and about rectangular.

The fifth end 32 may be adjacent to the first planar surface 18 and may be electrically connected to the first planar conductive surface. The seventh end 38 may be biased toward the sixth end 34 and may be electrically connected to the first conductive element 30. The eighth end 40 may be between the seventh end 38 and the first conductive matching element 22 and the fourth end 26 may be used to transfer RF signals between the RF antenna structure 10 and RF communications circuitry (not shown).

Figure 2:
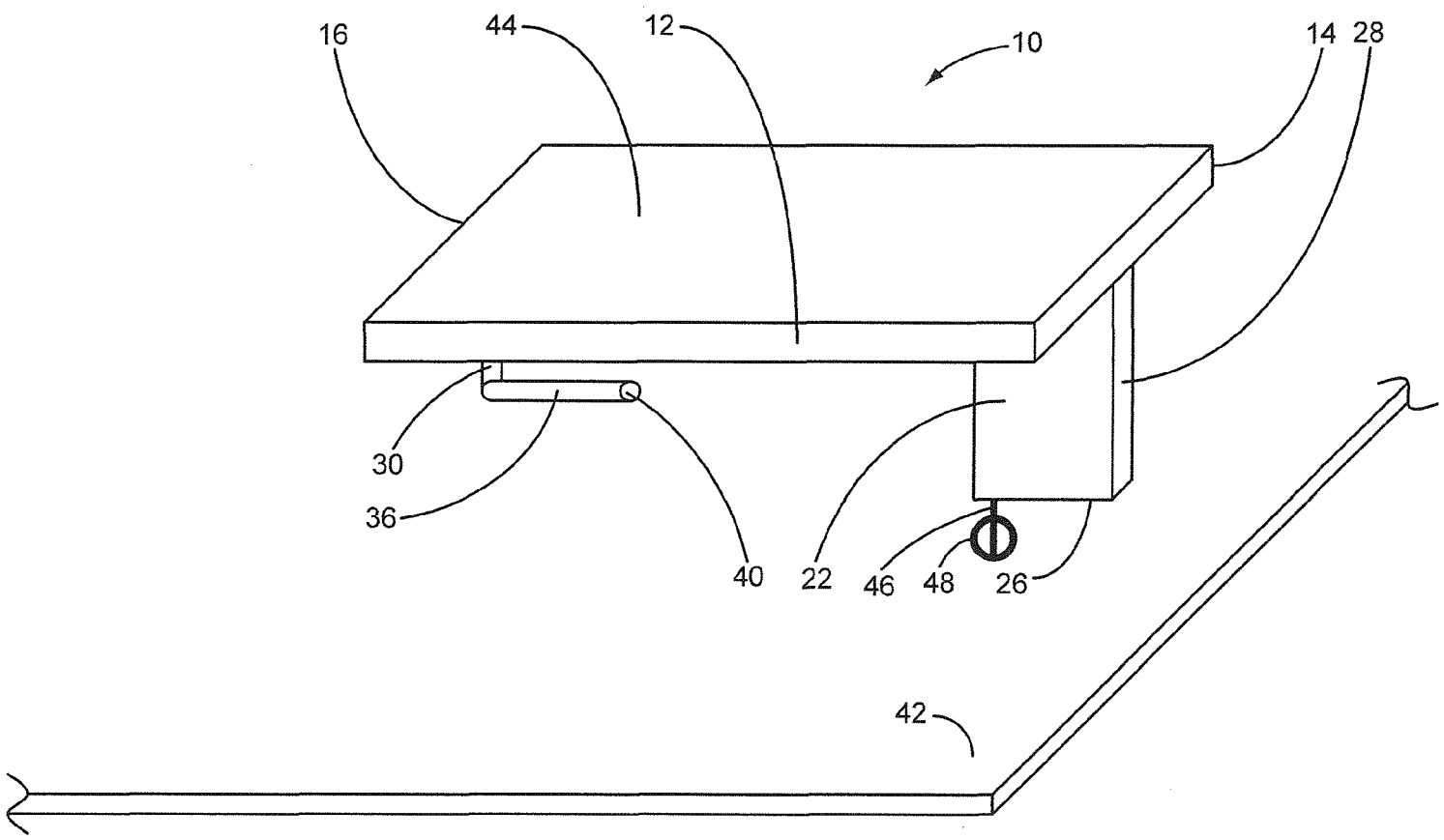
FIG. 2 shows a three-dimensional view from one side and above the RF antenna structure illustrated in FIG. 1.

FIG. 2 shows a three-dimensional view from one side and above the RF antenna structure 10 illustrated in FIG. 1. The RF antenna structure 10 is mounted above a ground plane 42, such that the first planar conductive surface and the first planar surface 18 are about parallel to the ground plane 42. The RF antenna structure 10 has a second planar surface 44. In one embodiment of the first conductive matching element 22, an RF antenna feedline 46 is electrically connected between the fourth end 26 and the RF communications circuitry (not shown). A ground plane clearance hole 48 allows the RF antenna feedline 46 to pass through the ground plane 42 without making an electrical connection to the ground plane 42.

In one embodiment of the loading plate 12, the second planar surface 44 provides the first planar conductive surface. In one embodiment of the present invention, the loading plate 12, the planar structure, and the ground plane 42 form a modified inverted-L single band RF antenna, which may be used to transmit RF signals, receive RF signals, or both. The first conductive matching element 22 provides the short section of the L and the loading plate 12 provides the long section of the L. The loading plate 12, the first conductive matching element 22, the first conductive element 30, and the second conductive matching element 36 provide the modifications to the modified inverted-L antenna, thereby providing an increased bandwidth compared to a traditional inverted-L antenna. The fourth end 26 may be between the third end 24 and the ground plane 42, and the sixth end 34 may be between the fifth end 32 and the ground plane 42.

The modified inverted-L single band RF antenna may be low profile. In an exemplary embodiment of the present invention, a distance between the first planar conductive surface and the ground plane 42 is less than about 12 millimeters. In one embodiment of the RF antenna structure 10, at least a portion of the fifth end 32 may contact a portion of the first planar surface 18, at least a portion of the fifth end 32 may contact a portion of the first planar conductive surface at the lengthwise centerline 20 of the first planar surface 18, the fifth end 32 may be biased towards the second end 16, the seventh end 38 may be adjacent to the sixth end 34, or any combination thereof.

The modified inverted-L single band RF antenna may provide a reasonably uniform omni-directional radiation pattern in the hemisphere above the ground plane 42. If the modified inverted-L single band RF antenna is used in a ceiling mounted WLAN access point with the RF antenna structure 10 closer to the floor and the ground plane 42 closer to the ceiling, the radiation pattern may be directed relatively uniformly downward throughout a room to provide good coverage to a number of end users. In one embodiment of the present invention, the modified inverted-L single band RF antenna is associated with an operating band having a center frequency, an upper frequency, and a lower frequency.

Return loss is one way to characterize an antenna's bandwidth. The return loss in an antenna is the difference between RF power delivered to an antenna and reflected RF power received back from the antenna, and is dependent on the load impedance. In one embodiment of the present invention, the load impedance is about 50 ohms; therefore the design target for the antenna input impedance is about 50 ohms in the desired operating bands. Low return loss indicates that most of the delivered RF power is being reflected back and that little of the delivered RF power is being radiated by the antenna. Conversely, high return loss indicates that little of the delivered RF power is being reflected back and that most of the delivered RF power is being radiated by the antenna. Therefore, the antenna will have high return loss (e.g. greater than 10 decibels) when transmitting RF signals with frequencies inside an operating band and will have low return loss when transmitting RF signals with frequencies outside the operating band. In one embodiment of the present invention, the bandwidth of an RF antenna may be characterized as the contiguous range of frequencies over which the return loss is greater than 10 decibels, such that a return loss with a 50 ohm load impedance is greater than about 10 decibels over a contiguous range of frequencies between the lower frequency and the upper frequency. The bandwidth may be expressed as a percentage of the center frequency, such that if f_upper and f_lower are the upper and lower frequencies bounding the range where the return loss is greater than 10 decibels, then the percentage bandwidth is given by (percentage bandwidth=((f_upper−f_lower)/f_center))×100), where f_center=(f_upper+$f_{_lower)}$/2.

In one exemplary embodiment of the modified inverted-l single band RF antenna, the bandwidth of the modified inverted-L single band RF antenna is at least 15 percent of the center frequency. In another exemplary embodiment of the modified inverted-L single band RF antenna, the center frequency is about 5.3625 gigahertz, the lower frequency is less than about 4.9 gigahertz, the upper frequency is greater than about 5.825 gigahertz, or any combination thereof.

FIG. 3 shows a three-dimensional view from one side and underneath a duel band RF antenna structure 50 according to an alternate embodiment of the present invention. The dual band RF antenna structure 50 illustrated in FIG. 3 is similar to the RF antenna structure 10 illustrated in FIG. 1, except the dual band RF antenna structure 50 illustrated in FIG. 3 includes a first dual band conductive element 52 and the fifth end 32 is biased closer to the first end 14 than the fifth end 32 illustrated in FIG. 1. The first dual band conductive element 52 includes a first dual band end 54 and a second dual band end 56. The first dual band end 54 may be adjacent to the eighth end 40 and the eighth end 40 may be electrically connected to the first dual band conductive element 52.

FIG. 4 shows a three-dimensional view from one side and above the dual band RF antenna structure 50 illustrated in FIG. 3. The second dual band end 56 may be electrically connected to the ground plane 42 at a ground plane attachment point 58. The first dual band conductive element 52 may be of any shape. In one embodiment, the first dual band conductive element 52 is about cylindrically shaped, as shown. The first dual band conductive element 52 may be formed from a metallic rod. In an alternate embodiment, the first dual band conductive element 52 is flat and about rectangular. In one embodiment of the present invention, the loading plate 12, the first conductive matching element 22, and the ground plane 42 may form a modified inverted-L RF antenna, and a portion of the loading plate 12 between the first end 14 and the fifth end 32, the first conductive matching element 22, the first conductive element 30, the second conductive matching element 36, the first dual band conductive element 52, and the ground plane 42 may form a bent folded-monopole RF antenna. Therefore, the loading plate 12, the planar structure, and the ground plane 42 may form a dual band RF antenna by superposition of the bent folded-monopole RF antenna and the modified inverted-L RF antenna. The dual band RF antenna may be used to transmit RF signals, receive RF signals, or both.

The dual band RF antenna may provide a reasonably uniform omni-directional radiation pattern in the hemisphere above the ground plane 42. If the dual band RF antenna is used in a ceiling mounted WLAN access point with the dual band RF antenna structure 50 closer to the floor and the ground plane 42 closer to the ceiling, the radiation pattern may be directed relatively uniformly downward throughout a room to provide good coverage to a number of end users. In one embodiment of the present invention, the dual band RF antenna is associated with a first operating band having a first center frequency, a first upper frequency, and a first lower frequency, and a second operating band having a second center frequency, a second upper frequency, and a second lower frequency.

In one exemplary embodiment of the dual band RF antenna, a first operating band bandwidth of the dual band RF antenna is at least 15 percent of the first center frequency, such that a magnitude of the first upper frequency minus a magnitude of the first lower frequency is at least 15 percent of a magnitude of the first center frequency, and a return loss with a 50 ohm load impedance is greater than about 10 decibels across a contiguous range of frequencies between the first lower frequency and the first upper frequency. In another exemplary embodiment of the dual band RF antenna, the first center frequency is about 5.3625 gigahertz, the first lower frequency is less than about 4.9 gigahertz, the first upper frequency is greater than about 5.825 gigahertz, the second center frequency is about 2.44175 gigahertz, or any combination thereof.

FIG. 5 shows a three-dimensional view from one side and underneath the RF antenna structure 10 according to an alternate embodiment of the RF antenna structure 10. The RF antenna structure 10 illustrated in FIG. 5 is similar to the RF antenna structure 10 illustrated in FIG. 1, except the first conductive element 30 and the second conductive matching element 36 illustrated in FIG. 1 are both cylindrically shaped, whereas the first conductive element 30 and the second conductive matching element 36 illustrated in FIG. 5 are both rectangularly shaped. The first conductive matching element 22 has a second edge 60, which may be about perpendicular to the first planar conductive surface and may be about parallel to and opposite from the first edge 28.

The second edge 60 may be between the first edge 28 and the first conductive element 30. The first conductive element 30 has a third edge 62 and a fourth edge 64, in which both may be about perpendicular to the first planar conductive surface. The fourth edge 64 may be about parallel to and opposite from the third edge 62, and the third edge 62 may be between the fourth edge 64 and the first conductive matching element 22. In one embodiment of the first conductive element 30, the fourth edge 64 is about flush with the second end 16, at least a portion of the seventh end 36 contacts a portion of the third edge 62, or both. FIG. 6 shows a three-dimensional view from one side and above the RF antenna structure 10 illustrated in FIG. 5.

FIG. 7 shows a three-dimensional view from one side and underneath the dual band RF antenna structure 50 according to an alternate embodiment of the dual band RF antenna structure 50. The dual band RF antenna structure 50 illustrated in FIG. 7 is similar to the dual band RF antenna structure 50 illustrated in FIG. 3, except the first conductive element 30, the second conductive matching element 36, and the first dual band conductive element 52 illustrated in FIG. 3 are all three cylindrically shaped, whereas the first conductive element 30, the second conductive matching element 36, and the first dual band conductive element 52 illustrated n FIG. 7 are all three rectangularly shaped. The first conductive matching element 22 has the second edge 60, which may be about perpendicular to the first planar conductive surface and may be about parallel to and opposite from the first edge 28.

The second edge 60 may be between the first edge 28 and the first conductive element 30. The first conductive element 30 has the third edge 62 and the fourth edge 64, in which both may be about perpendicular to the first planar conductive surface. The fourth edge 64 may be about parallel to and opposite from the third edge 62, and the third edge 62 may be between the fourth edge 64 and the first conductive matching element 22. The first dual band conductive element 52 has a first dual band edge 66, such that at least a portion of the eighth end 40 may contact a portion of the first dual band edge 66. FIG. 8 shows a three-dimensional view from one side and above the dual band RF antenna structure 50 illustrated in FIG. 7.

FIG. 9 shows a three-dimensional view from one side and underneath the RF antenna structure 10 according to an additional embodiment of the RF antenna structure 10. The RF antenna structure 10 illustrated in FIG. 9 is similar to the RF antenna structure 10 illustrated in FIG. 5, except the RF antenna structure 10 illustrated in FIG. 9 includes a second conductive element 68. The second conductive element 68 has a ninth end 70, a tenth end 72, and a fifth edge 74. The second conductive element 68 may be flat having edges and ends of any shape. In one embodiment, the second conductive element 68 is flat and about rectangular, as shown. The ninth end 70 may be electrically connected to the first conductive matching element 22 and at least a portion of the ninth end 70 may contact a portion of the second edge 60. The tenth end 72 may be electrically connected to the first conductive element 30 and at least a portion of the tenth end 72 may contact a portion of the third edge 62. The fifth edge 74 may be electrically connected to the first planar conductive surface. In one embodiment of the second conductive element 68, the fifth edge 74 may be about flush with the third end 24, the fifth edge 74 may be about flush with the fifth end 32, at least a portion of the fifth edge 74 may contact a portion of the first planar surface 18, or any combination thereof.

FIG. 10 shows a three-dimensional view from one side and underneath the RF antenna structure 10 according to another embodiment of the RF antenna structure 10. The RF antenna structure 10 illustrated in FIG. 10 is similar to the RF antenna structure 10 illustrated in FIG. 9, except the RF antenna structure 10 illustrated in FIG. 10 includes a third conductive element 76. The third conductive element 76 has an eleventh end 78, a twelfth end 80, and a sixth edge 82. The third conductive element 76 may be flat having edges and ends of any shape. In one embodiment, the third conductive element 76 is flat and about square, as shown. In one embodiment of the third conductive element 76, the eleventh end 76 may be electrically connected to the first conductive matching element 22, at least a portion of the eleventh end 78 may contact a portion of the fourth end 26, the second edge 60 may be about flush with the sixth edge 82, the twelfth end 80 may be used to transfer RF signals between the RF antenna structure 10 and RF communications circuitry (not shown), or any combination thereof. FIG. 11 shows a three-dimensional view from one side and above the RF antenna structure 10 illustrated in FIG. 10.

FIG. 12 shows a three-dimensional view from one side and underneath the dual band RF antenna structure 50 according to an additional embodiment of the dual band RF antenna structure 50. The dual band RF antenna structure 50 illustrated in FIG. 12 is similar to the dual band RF antenna structure 50 illustrated in FIG. 7, except the dual band RF antenna structure 50 illustrated in FIG. 12 includes the second conductive element 68. The second conductive element 68 has the ninth end 70, the tenth end 72, and the fifth edge 74. The second conductive element 68 may be flat having edges and ends of any shape. In one embodiment, the second conductive element 68 is flat and about rectangular, as shown. The ninth end 70 may be electrically connected to the first conductive matching element 22 and at least a portion of the ninth end 70 may contact a portion of the second edge 60. The tenth end 72 may be electrically connected to the first conductive element 30 and at least a portion of the tenth end 72 may contact a portion of the third edge 62. The fifth edge 74 may be electrically connected to the first planar conductive surface. In one embodiment of the second conductive element 68, the fifth edge 74 may be about flush with the third end 24, the fifth edge 74 may be about flush with the fifth end 32, at least a portion of the fifth edge 74 may contact a portion of the first planar surface 18, or any combination thereof.

FIG. 13 shows a three-dimensional view from one side and underneath the dual band RF antenna structure 50 according to another embodiment of the dual band RF antenna structure 50. The dual band RF antenna structure 50 illustrated in FIG. 13 is similar to the dual band RF antenna structure 50 illustrated in FIG. 12, except the dual band RF antenna structure 50 illustrated in FIG. 13 includes a second dual band conductive element 84. The second dual band conductive element 84 has a third dual band end 86, a fourth dual band end 88, and a second dual band edge 90. The second dual band conductive element 84 may be flat having edges and ends of any shape. In one embodiment, the second dual band conductive element 84 is flat and about rectangular, as shown. In one embodiment of the second dual band conductive element 84, at least a portion of the third dual band end 86 may contact a portion of the fourth edge 64, the third dual band end 86 may be electrically connected to the first conductive element 30, at least a portion of the second dual band edge 90 may contact a portion of the first planar surface 18, the second dual band edge 90 may be electrically connected to the first planar conductive surface, the fourth dual band end 88 may be about flush with the second end 16, or any combination thereof.

FIG. 14 shows a three-dimensional view from one side and underneath the dual band RF antenna structure 50 according to a supplemental embodiment of the dual band RF antenna structure 50. The dual band RF antenna structure 50 illustrated in FIG. 14 is similar to the dual band RF antenna structure 50 illustrated in FIG. 13, except the dual band RF antenna structure 50 illustrated in FIG. 14 includes the third conductive element 76. The third conductive element 76 has the eleventh end 78, the twelfth end 80, and the sixth edge 82. The third conductive element 76 may be flat having edges and ends of any shape. In one embodiment, the third conductive element 76 is flat and about square, as shown. In one embodiment of the third conductive element 76, the eleventh end 78 may be electrically connected to the first conductive matching element 22, at least a portion of the eleventh end 78 may contact a portion of the fourth end 26, the second edge 60 may be about flush with the sixth edge 82, the twelfth end 80 may be used to transfer RF signals between the dual band RF antenna structure 50 and RF communications circuitry (not shown), or any combination thereof.

FIG. 15 shows details of the dual band RF antenna structure 50 illustrated in FIG. 14. A first effective length 92 is the distance from the first end 14 to fifth end 32 of the first conductive element 30 and may be on the order of about one quarter wavelength of a center frequency of one of the two frequency bands associated with the dual band RF antenna structure 50. A first length 94 is the distance from the first end 14 to the second end 16 and may be on the order of about one quarter wavelength of a center frequency of the other of the two frequency bands associated with the dual band RF antenna structure 50.

A way to relate the first length 94 and the first effective length 92 to frequency is presented below. A fundamental equation relating to wavelength (λ) of a radiated RF signal to the frequency (F) of the radiated RF signal traveling at the speed of light (C) is shown in EQ. 1 below.

$$\lambda = C/F. \qquad \text{EQ. 1}$$

Since C is about equal to $3\times10^8$ meters/second (M/S), substituting the value of C into EQ. 1 provides EQ. 2 below.

$$\lambda = (3\times10^8\ \text{M/S})/F. \qquad \text{EQ. 2}$$

Converting the speed of light into the units of millimeters (mm) per nanosecond (mm/nS), the frequency into GHz (i.e. 1/nS) provides EQ. 3 below.

$$\lambda = (300\ \text{mm/nS})/F(\text{GHz}). \qquad \text{EQ. 3}$$

Useful values may occur at λ/2, λ/4, and λ/8 as shown in EQ. 4, EQ. 5, and EQ. 6, respectively below.

$$\lambda/2 = (150\ \text{mm/nS})/F(\text{GHz}). \qquad \text{EQ. 4}$$

$$\lambda/4 = (75\ \text{mm/nS})/F(\text{GHz}). \qquad \text{EQ. 5}$$

$$\lambda/8 = (37.5\ \text{mm/nS})/F(\text{GHz}). \qquad \text{EQ. 6}$$

In one embodiment of the present invention, the RF antenna structure 10 and the ground plane 42 form the modified inverted-L single band RF antenna, which is associated with an operating band having a center frequency. If the first length 94 is on the order of about one quarter wavelength (λ/4) of the center frequency, then EQ. 5 relates the first length 94 to the center frequency. If a factor of two tolerance is established, then EQ. 4 and EQ. 6 provide tolerance limits for the first length 94. In en exemplary embodiment of the modified inverted-L single band RF antenna, a first value is equal to about 150 mm/nS divided by a magnitude of the center frequency (in GHz), a second value is equal to about 37.5 mm/nS divided by the magnitude of the center frequency (in GHz), and a magnitude of the first length 94 is between the first value and the second value.

In an alternate embodiment of the present invention, the dual band RF antenna structure 50 and the ground plane 42 form the dual band RF antenna, which is associated with a first operating band having a first center frequency and a second operating band having a second center frequency. If the first length 94 is on the order of about one quarter wavelength (λ/4) of the second center frequency, then EQ. 5 relates the first length 94 to the second center frequency. If a factor of two tolerance is established, then EQ. 4 and EQ. 6 provide tolerance limits for the first length 94. Similarly, if the first effective length 92 is on the order of about one quarter wavelength (λ/4) of the first center frequency, then EQ. 5 relates the first effective length 92 to the first center frequency. If a factor of two tolerance is established, then EQ. 4 and EQ. 6 provide tolerance limits for the first effective length 92. In an exemplary embodiment of the dual band RF antenna, a first value is equal to about 150 mm/nS divided by a magnitude of the first center frequency (in GHz), a second value is equal to about 37.5 mm/nS divided by the magnitude of the first center frequency (in GHz), a third value is equal to about 150 mm/nS divided by a magnitude of the second center frequency (in GHz), a fourth value is equal to about 37.5 mm/nS divided by the magnitude of the second center frequency (in GHz), a magnitude of the first length 94 is between the third value and the fourth value, and a magnitude of the first effective length 92 is between the first value and the second value.

FIG. 16 shows details of the RF antenna structure 10 illustrated in FIG. 1. The loading plate 12 has the first length 94 and a first width 96, in which both may be about parallel to the ground plane 42 (FIG. 2). The first conductive matching element 22 has a second length 98 and a second width 100, such that the second length 98 may be about perpendicular to the first planar conductive surface, the second width 100 may be about parallel to the first length 94, or both. The first conductive element 30 has a third length 102 and a third width 104, such that the third length 102 may be about perpendicular to the first planar conductive surface. The second conductive matching element 36 has a fourth length 106 and a fourth width 108, such that the fourth length 106 is about parallel to the first length 94.

FIG. 17 shows details of the RF antenna structure 10 illustrated in FIG. 10. The loading plate 12 has the first length 94 and the first width 96, in which both may be about parallel to the ground plane 42 (FIG. 11). The first conductive matching element 22 has the second length 98 and the second width 100, such that the second length 98 may be about perpendicular to the first planar conductive surface, the second width 100 may be about parallel to the first length 94, or both. The first conductive element 30 has the third length 102 and the third width 104, such that the third length 102 may be about perpendicular to the first planar conductive surface, the third width 104 may be about parallel to the first length 94, or both. The second conductive matching element 36 has the fourth length 106 and the fourth width 108, such that the fourth length 106 is about parallel to the first length 94, the fourth width 106 may be about perpendicular to the first planar conductive surface, or both. The second conductive element 68 has a fifth length 110 and a fifth width 112. The fifth length 110 may be about parallel to the first length 94, the fifth width 112 may be about perpendicular to the first planar conductive surface, or both. The third conductive element 76 has a sixth length 114 and a sixth width 116. The sixth length 114 may be about perpendicular to the first planar conductive surface, sixth width 116 may be about parallel to the first length 94, or both.

FIG. 18 shows additional details of the dual band RF antenna structure 50 illustrated in FIG. 14. The loading plate 12 has the first length 94 and the first width 96, in which both may be about parallel to the ground plane 42 (FIG. 15). The first conductive matching element 22 has the second length 98 and the second width 100, such that the second length 98 may be about perpendicular to the first planar conductive surface, the second width 100 may be about parallel to the first length 94, or both. The first conductive element 30 has the third length 102 and the third width 104, such that the third length 102 may be about perpendicular to the first planar conductive surface, the third width 104 may be about parallel to the first length 94, or both. The second conductive matching element 36 has the fourth length 106 and the fourth width 108, such that the fourth length 106 may be about parallel to the first length 94, the fourth width 108 may be about perpendicular to the first planar conductive surface, or both. The second conductive element 68 has the fifth length 110 and the filth width 112. The fifth length 110 may be about parallel to the first length 94, the fifth width 112 may be about perpendicular to the first planar conductive surface, or both. The third conductive element 76 has the sixth length 114 and the sixth width 116. The sixth length 114 may be about perpendicular to the first planar conductive surface, the sixth width 116 may be about parallel to the first length 94, or both. The first dual band conductive element 52 has a first dual band length 118 and a first dual band width 120. The first dual band length 118 may be about perpendicular to the first planar conductive surface, the first dual band width 120 may about parallel to the first length 94, or both. The second dual band conductive element 84 has a second dual band length 122 and a second dual band width 124. The second dual band length 122 may be about parallel to the first length 94, the second dual band width 124 may be about perpendicular to the first planar conductive surface, or both.

FIG. 19 shows the loading plate 12 according to a first embodiment of the loading plate 12. The loading plate 12 may be formed using a first metallic sheet 126, such as a stamped metal sheet. The first metallic sheet 126 may include cooper, brass, silver, gold, one or more other metals, or any combination thereof. The loading plate 12 has the first planar surface 18 and the second planar surface 44, either of which may provide the first planar conductive surface and the other may provide a second planar conductive surface. The first planar conductive surface may be continuously conductive without any insulating areas.

FIG. 20 shows the loading plate 12 according to a second embodiment of the loading plate 12. The loading plate 12 may be formed using a first loading plate conductive layer 128 and a loading plate dielectric layer 130. The first loading plate conductive layer 128 may include copper, brass, silver, gold, one or more other metals, or any combination thereof. The loading plate dielectric layer 130 may include glass epoxy, one or more other dielectric materials, or any combination thereof. The first loading plate conductive layer 128 is about parallel to the loading plate dielectric layer 130. The first loading plate conductive layer 128 may be bonded directly to the loading plate dielectric layer 130, or there may be one of more intervening layers between the first loading plate conductive layer 128 and the loading plate dielectric layer 130. Printed circuit board (PCB) material may provide the first loading plate conductive layer 128 and the loading plate dielectric layer 130. The first loading plate conductive layer 128 provides the first planar surface 18, which provides the first planar conductive surface. The loading plate dielectric layer 130 provides the second planar surface 44. The first planar conductive surface may be continuously conductive without any insulating areas. PCB material may typically be inexpensive, and antennas fabricated using PCB material may be very cost effective. Additionally, other elements of a WLAN access point may be provided using PCB material; therefore, providing the RF antenna structure 10 or the dual band RF antenna structure 50 using PCB material may provide commonality of construction materials, methods, or both. Further, PCB materials typically have a dielectric constant greater than one; therefore, sizes of the RF antenna structure 10 or the dual band RF antenna structure 50 using PCB material may be different from the sizes of the RF antenna structure 10 or the dual band RF antenna structure 50, respectively, when using a metallic sheet or other materials, which may be advantageous in certain applications.

FIG. 21 shows the loading plate 12 according to a third embodiment of the loading plate 12. The loading plate 12 may be formed using the first loading plate conductive layer 128 and the loading plate dielectric layer 130. The first loading plate conductive layer 128 may include copper, brass, silver, gold, one or more other metals, or any combination thereof. The loading plate dielectric layer 130 may include glass epoxy, one or more other dielectric materials, or any combination thereof. The first loading plate conductive layer 128 is about parallel to the loading plate dielectric layer 130. The first loading plate conductive layer 128 may be bonded directly to the loading plate dielectric layer 130, or there may be one or more intervening layers between the first loading plate conductive layer 128 and the loading plate dielectric layer 130. PCB material may provide the first loading plate conductive layer 128 and the loading plate dielectric layer 130.

The loading plate dielectric layer 130 provides the first planar surface 18 and the first loading plate conductive layer 128 provides the second planar surface 44, which provides the first planar conductive surface. However, since the planar structure (not shown) is mounted adjacent to the first planar surface 18 and since the planar structure (not shown) is electrically connected to the first planar conductive surface, which resides on the second planar surface 44, the loading plate dielectric layer 130 includes multiple via holes 132 to provide electrically conductive pathways between the planar structure (not shown) and the first loading plate conductive layer 128, which may or may not have the multiple via holes 132. Therefore, the first planar conductive surface may be continuously conductive without any insulating areas, or the first planar conductive surface may be continuously conductive without any insulating areas except for the multiple via holes 132. Each of the multiple via holes 132 may be conductively plated or may include a conductive element traversing through the hole.

FIG. 22 shows the loading plate 12 according to a fourth embodiment of the loading plate 12. The loading plate 12 may be formed using the first loading plate conductive layer 128, a second loading plate conductive layer 134, and the loading plate dielectric layer 130, which is between the first loading plate conductive layer 128 and the second loading plate conductive layer 134. The first loading plate conductive layer 128 may include copper, brass, gold, one or more other metals, or any combination thereof. The second loading plate conductive layer 134 may include copper, brass, silver, gold, one or more other metals, or any combination thereof. The loading plate dielectric layer 130 may include glass epoxy, one or more other dielectric materials, or any combination thereof. The first loading plate conductive layer 128 may be bonded directly to the loading plate dielectric layer 130, or there may be one or more intervening layers between the first loading plate conductive layer 128 and the loading plate dielectric layer 130. Similarly, the second loading plate conductive layer 134 may be bonded directly to the loading plate dielectric layer 130, or there may be one or more intervening layers between the second loading plate conductive layer 134 and the loading plate dielectric layer 130. PCB material may provide the first loading plate conductive layer 128, the second loading plate conductive layer 134, and the loading plate dielectric layer 130.

The first loading plate conductive layer 128 provides the first planer surface 18 and the second loading plate conductive layer 134 provides the second planar surface 44. The first planar surface 18 may provide the first planar conductive surface and the second planar surface 44 may provide a second planar conductive surface. The loading plate dielectric layer 130 may include multiple via holes 132 to provide electrically conductive pathways between the first loading plate conductive layer 128 and the second loading plate conductive layer 134, thereby electrically connecting the first loading plate conductive layer 128 to the second loading plate conductive layer 134. The first loading plate conductive layer 128 may or may not have the multiple via holes 132. Therefore, the first planar conductive surface may be continuously conductive without any insulating areas, or the first planar conductive surface may be continuously conductive without any insulating areas except for the multiple via holes 132. Each of the multiple via holes 132 may be conductively plated or may include a conductive element traversing through the hole.

The first end 14 of the loading plate dielectric layer 130 may extend beyond the first end 14 of the first loading plate conductive layer 128, beyond the first end 14 of the second loading plate conductive layer 134, or both. The second end 16 of the loading plate dielectric layer 130 may extend beyond the second end 16 of the first loading plate conductive layer 128, beyond the second end 16 of the second loading plate conductive layer 134, or both. One edge of the loading plate dielectric layer 130 may extend beyond the corresponding edge of the first loading plate conductive layer 128, beyond the corresponding edge of the second loading plate conductive layer 134, or both. An opposite edge of the loading plate dielectric layer 130 may extend beyond the corresponding opposite edge of the first loading plate conductive layer 128, beyond the corresponding opposite edge of the second loading plate conductive layer 134, or both.

In addition to the multiple via holes 132 electrically connecting the first loading plate conductive layer 128 to the second loading plate conductive layer 134, conductive layers on the first end 14 of the loading plate dielectric layer 130, on the second end 16 of the loading plate dielectric layer 130, on one edge of the loading plate dielectric layer 130, on the opposite edge of the loading plate dielectric layer 130, or any combination thereof, may electrically connect the first loading plate conductive layer 128 to the second loading plate conductive layer 134.

FIG. 23 shows a planar structure 136, which may be used in the RF antenna structure 10 illustrated in FIG. 10 according to a first embodiment of the planar structure 136. The planar structure 136 may be formed using a second metallic sheet 137, such as a stamped metal sheet. The second metallic sheet 137 may include cooper, brass, silver, gold, one or more other metals, or any combination thereof. The planar structure 136 may include the first conductive matching element 22, the first conductive element 30, the second conductive matching element 36, the second conductive element 68, the third conductive element 76, or any combination thereof, and the second metallic sheet 137 provides the corresponding first conductive matching element 22, the first conductive element 30, the second conductive matching element 36, the second conductive element 68, the third conductive element 76, or any combination thereof.

FIG. 24 shows the planar structure 136, which may be used in the RF antenna structure 10 illustrated in FIG. 10 according to a second embodiment of the planar structure 136. The planar structure 136 may be formed using a first planar structure conductive layer 138 and a planar structure dielectric layer 140. The first planar structure conductive layer 138 may include copper, brass, silver, gold, one or more other metals, or any combination thereof. The planar structure dielectric layer 140 may include glass epoxy, one or more other dielectric materials, or any combination thereof. The first planar structure conductive layer 138 is about parallel to the planar structure dielectric layer 140. The first planar structure conductive layer 138 may be bonded directly to the planar structure dielectric layer 140, or there may be one or more intervening layers between the first planar structure conductive layer 138 and the planar structure dielectric layer 140. PCB material may provide the first planar structure conductive layer 138 and the planar structure dielectric layer 140.

The planar structure 136 may include the first conductive matching element 22, the first conductive element 30, the second conducive matching element 36, the second conductive element 68, the third conductive element 76, or any combination thereof, and the first planar structure conductive layer 138 provides the corresponding first conductive matching element 22, the first conductive element 30, the second conductive matching element 36, the second conductive element 68, the third conductive element 76, or any combination thereof.

FIG. 25 shows the planar structure 136, which may be used in the RF antenna structure 10 illustrated in FIG. 10 according to a third embodiment of the planar structure 136. The planar structure 136 may be formed using the first planar structure conductive layer 138, a second planar structure conductive layer 142, and the planar structure dielectric layer 140 between the first planar structure conductive layer 138 and the second planar structure conductive layer 142. The first planar structure conductive layer 138 may include copper, brass, silver, gold, one or more other metals, or any combination thereof. The second planar structure conductive layer 142 may include cooper, brass, silver, gold, one or more other metals, or any combination thereof. The planar structure dielectric layer 140 may include glass epoxy, one or more other dielectric materials, or any combination thereof. The first planar structure conductive layer 138 may be bonded directly to the planar structure dielectric layer 140, or there may be one or more intervening layers between the first planar structure conductive layer 138 and the planar structure dielectric layer 140. Similarly, the second planar structure conductive Layer 142 may be bonded directly to the planar structure dielectric layer 140, or there may be one or more intervening layers between the second planar structure conductive layer 142 and the planar structure dielectric layer 140. PCB materiel may provide the first planar structure conductive layer 138, the second planar structure conductive layer 142, and the planar structure dielectric layer 140.

The planar structure 136 may include the first conductive matching element 22, the first conductive element 30, the second conductive matching element 36, the second conductive element 68, the third conductive element 76, or any combination thereof, and the first planar structure conductive layer 138 provides the corresponding first conductive matching element 22, the first conductive element 30, the second conductive matching element 36, the second conductive element 68, the third conductive element 76, or any combination thereof.

FIG. 26 shows the planar structure 136, which may be used in the dual band RF antenna structure 50 illustrated in FIG. 14 according to a fourth embodiment of the planar structure 136. The planar structure 136 may be formed using the second metallic sheet 137, such as a stamped metal sheet. The second metallic sheet 137 may include copper, brass, silver, gold, one or more other metals, or any combination thereof. The planar structure 136 may include the first conductive matching element 22, the first conductive element 30, the second conductive matching element 36, the second conductive element 68, the third conductive element 76, the first dual band conductive element 52, the second dual band conductive element 84, or any combination thereof, and the second metallic sheet 137 provides the corresponding first conductive matching element 22, the first conductive element 30, the second conductive matching element 36, the second conductive element 68, the third conductive element 76, the first dual band conductive element 52, the second dual band conductive element 84, or any combination thereof.

FIG. 27 shows the planar structure 136, which may be used in the dual band RF antenna structure 50 illustrated in FIG. 14 according to a fifth embodiment of the planar structure 136. The planer structure 136 may be formed using the first planar structure conductive layer 138 and the planar structure dielectric layer 140. The first planar structure conductive layer 138 may include copper, brass, silver, gold, one or more other metals, or any combination thereof. The planar structure dielectric layer 140 may include glass epoxy, one or more other dielectric materials, or any combination thereof. The first planar structure conductive layer 138 is about parallel to the planar structure dielectric layer 140. The first planar structure conductive layer 138 may be bonded directly to the planar structure dielectric layer 140, or there may be one or more intervening layers between the first planar structure conductive layer 138 and the planar structure dielectric layer 140. PCB material may provide the first planar structure conductive layer 138 and the planar structure dielectric layer 140.

The planar structure 136 may include the first conductive matching element 22, the first conductive element 30, the second conductive matching element 36, the second conductive element 68, the third conductive element 76, the first dual band conductive element 52, the second dual band conductive element 84, or any combination thereof, and the first planar structure conductive layer 138 provides the corresponding first conductive matching element 22, the first conductive element 30, the second conductive matching element 36, the second conductive element 68, the third conductive element 76, the first dual band conductive element 52, the second dual band conductive element 84, or any combination thereof.

FIG. 28 shows the planar structure 136, which may be used in the dual band RF antenna structure 50 illustrated in FIG. 14 according to a sixth embodiment of the planar structure 136. The planar structure 136 may be formed using the first planar structure conductive layer 138, the second planar structure conductive layer 142, and the planar structure dielectric layer 140 between the first planar structure conductive layer 138 and the second planar structure conductive layer 142. The first planar structure conductive layer 138 may include copper, brass, silver, gold, one or more other metals, or any combination thereof. The second planar structure conductive layer 142 may include copper, brass, silver, gold, one or more other metals, or any combination thereof. The planar structure dielectric layer 140 may include glass epoxy, one or more other dielectric materials, or any combination thereof. The first planar structure conductive layer 138 may be bonded directly to the planar structure dielectric layer 140, or there may be one or more intervening layers between the first planar structure conductive layer 138 and the planar structure dielectric layer 140. Similarly, the second planar structure conductive layer 142 may be bonded directly to the planar structure dielectric layer 140, or there may be one or more intervening layers between the second planar structure conductive layer 142 and the planar structure dielectric layer 140. PCB material may provide the first planar structure conductive layer 138, the second planar structure conductive layer 142, and the planar structure dielectric layer 140.

The planer structure 136 may include the first conductive matching element 22, the first conductive element 30, the second conductive matching element 36, the second conductive element 68, the third conductive element 76, the first dual band conductive element 52, the second dual band conductive element 84, or any combination thereof, and the first planar structure conductive layer 138 provides the corresponding first conductive matching element 22, the first conductive element 30, the second conductive matching element 36, the second conductive element 68, the third conductive element 76, the first dual band conductive element 52, the second dual band conductive element 84, or any combination thereof.

A first exemplary embodiment of the RF antenna structure 10 is illustrated in FIG. 17, such that a magnitude of the first length 94 is equal to about 23 millimeters, a magnitude of the second length 98 is equal to about 8 millimeters, a magnitude of the third length 102 is equal to about 7 millimeters, a magnitude of the fourth length 106 is equal to about 8 millimeters, a magnitude of the fifth length 110 is equal to about 16 millimeters, a magnitude of the sixth length 114 is equal to about 2 millimeters, a magnitude of the first width 96 is equal to about 8 millimeters, a magnitude of the second width 100 is equal to about 5 millimeters, a magnitude of the third width 104 is equal to about 2 millimeters, a magnitude of the fourth width 108 is equal to about 2 millimeters, a magnitude of the fifth width 112 is equal to about 2 millimeters, and a magnitude of the sixth width 116 is equal to about 2 millimeters.

A second exemplary embodiment of the FF antenna structure 10 is illustrated in FIG. 17, such that a magnitude of the first length 94 is equal to about 17 millimeters, a magnitude of the second length 98 is equal to about 5 millimeters, a magnitude of the third length 102 is equal to about 5.5 millimeters, a magnitude of the fourth length 106 is equal to about 2 millimeters, a magnitude of the fifth length 110 is equal to about 11 millimeters, a magnitude of the sixth length 114 is equal to about 2 millimeters, a magnitude of the first width 96 is equal to about 7 millimeters, a magnitude of the second width 100 is equal to about 4 millimeters, a magnitude of the third width 104 is equal to about 2 millimeters, a magnitude of the fourth width 108 is equal to about 2 millimeters, a magnitude of the fifth width 112 is equal to about 2 millimeters, and a magnitude of the sixth width 116 is equal to about 2 millimeters. The loading plate 12 is illustrated in FIG. 22, such that the loading plate dielectric layer 130 is about 1.6 millimeters thick and is formed using Flame Retardant 4 (FR4) PCB material. The first and the second ends 14, 16 of the loading plate dielectric layer 130 may extend beyond the first and the second ends 14, 16 of the first loading plate conductive layer 128 and the second loading plate conductive layer 134. In addition to the multiple via holes 132 electrically connecting the first loading plate conductive layer 128 to the second loading plate conductive layer 134, conductive layers on the edges of the loading plate dielectric layer 130 may electrically connect the first loading plate conductive layer 128 to the second loading plate conductive layer 134. The planar structure 136 is illustrated in FIG. 24, such that the planar structure dielectric layer 140 is about 1.6 millimeters thick and is formed using the FR4 PCB material.

A first exemplary embodiment of the dual band RF antenna structure 50 is illustrated in FIG. 18, such that a magnitude of the first length 94 is equal to about 29.5 millimeters, a magnitude of the second length 98 is equal to about 6.5 millimeters, a magnitude of the third length 102 is equal to about 6.5 millimeters, a magnitude of the fourth length 106 is equal to about 10.5 millimeters, a magnitude of the fifth length 110 is equal to about 16 millimeters, a magnitude of the sixth length 114 is equal to about 2.5 millimeters, a magnitude of the first dual band length 118 is equal to about 4.5 millimeters, a magnitude of the second dual band length 122 is equal to about 7.5 millimeters, a magnitude of the first width 96 is equal to about 7 millimeters, a magnitude of the second width 100 is equal to about 4 millimeters, a magnitude of the third width 104 is equal to about 2 millimeters, a magnitude of the fourth width 108 is equal to about 2 millimeters, a magnitude of the fifth width 112 is equal to about 2 millimeters, a magnitude of the sixth width 116 is equal to about 2 millimeters, a magnitude of the first dual band width 120 is equal to about 2 millimeters, and a magnitude of the second dual band width 124 is equal to about 2 millimeters.

A second exemplary embodiment of the dual band RF antenna structure 50 is illustrated in FIG. 18, such that a magnitude of the first length 94 is equal to about 23 millimeters, a magnitude of the second length 98 is equal to about 5.5 millimeters, a magnitude of the third length 102 is equal to about 5.5 millimeters, a magnitude of the fourth length 105 is equal to about 4.5 millimeters, a magnitude of the fifth length 110 is equal to about 10 millimeters, a magnitude of the sixth length 114 is equal to about 2.5 millimeters, a magnitude of the first dual band length 118 is equal to about 4.5 millimeters, a magnitude of the second dual band length 122 is equal to about 7 millimeters, a magnitude of the first width 96 is equal to about 7 millimeters, a magnitude of the second width 100 is equal to about 4 millimeters, a magnitude of the third width 104 is equal to about 2 millimeters, a magnitude of the fourth width 108 is equal to about 2 millimeters, a magnitude of the fifth width 112 is equal to about 2 millimeters, a magnitude of the sixth width 116 is equal to about 2 millimeters, a magnitude of the first dual band width 120 is equal to about 2 millimeters, a magnitude of the second dual band width 124 is equal to about 2 millimeters. The loading plate 12 is illustrated in FIG. 22, such that the loading plate dielectric layer 130 is about 1.6 millimeters thick and is formed using the FR4 PCB material. The first and the second ends 14, 16 of the loading plate dielectric layer 130 may extend beyond the first and the second ends 14, 16 of the first loading plate conductive layer 126 and the second loading plate conductive layer 134. In addition to the multiple via holes 132 electrically connecting the first loading plate conductive layer 128 to the second loading plate conductive layer 134, conductive layers on the edges of the loading plate dielectric layer 130 may electrically connect the first loading plate conductive layer 128 to the second loading plate conductive layer 134. The planar structure 136 is illustrated in FIG. 27, such that the planar structure dielectric layer 140 is about 1.6 millimeters thick and is formed using the FR4 PCB material.

An application example of the RF antenna structure 10 or the dual band RF antenna structure 50 is their use to form an RF antenna 144, which is included in a wireless local area network (WLAN) access point 146, the basic architecture of which is represented in FIG. 29. The WLAN access point 146 may include a receiver front end 148, a radio frequency transmitter section 150, the RF antenna 144, a duplexer or switch 152, a baseband processor 154, a control system 156, and a frequency synthesizer 158. The receiver front end 148 receives information bearing RF signals from one or more end users (not shown). A low noise amplifier (LNA) 160 amplifies the signal. A filter circuit 162 minimizes broadband interference in the received signal, while down conversion and digitization circuitry 164 down converts the filtered, received signal to an intermediate or baseband frequency signal, which is then digitized into one or more digital streams. The receiver front end 148 typically uses one or more mixing frequencies generated by the frequency synthesizer 158. The baseband processor 154 processes the digitized received signal to extract information or data bits conveyed in the received signal. This processing typically comprises demodulation, decoding, and error correction operations. As such, the baseband processor 154 is generally implemented in one or more digital signal processors (DSPs).

On the transmit side, the baseband processor 154 receives digitized data, which may represent voice, data, or control information, from the control system 156, which the baseband processor 154 encodes for transmission to the end users. The encoded data is output to the transmitter 150, where it is used by a modulator 156 to modulate a carrier signal that is at a desired transmit frequency. Power amplifier circuitry 168 amplifies the modulated carrier signal to a level appropriate for transmission, and delivers the amplified and modulated carrier signal to the antenna 144 through the duplexer or switch 152.

Those skilled in the art will recognize improvements and modifications to the preferred embodiments of the present invention. All such improvements and modifications are considered within the scope of the concepts disclosed herein and the claims that follow.

What is claimed is:

1. An antenna structure, comprising:

a ground plane;

a loading plate spaced from the ground plane in a direction substantially perpendicular to the ground plane and extending substantially parallel to the ground plane;

a first conductive matching element extending from the loading plate toward the ground plane, wherein the first conductive matching element is electrically connected to the loading plate and is electrically isolated from the ground plane;

a first conductive element extending from the loading plate toward the ground plane; and a second conductive matching element extending from the first conductive element spaced from and between the ground plane and the loading plate;

wherein the first conductive matching element, the first conductive element and the second conductive matching element are in a common plane, the common plane extending substantially perpendicular to the loading plate and the ground plane, wherein the first conductive matching element, the first conductive element and the second conductive matching element comprise an integral conductive structure, and wherein the integral conductive structure further comprises a second conductive element extending along the common plane from the first conductive element to the first conductive matching element.

2. The antenna structure of claim 1, wherein the first conductive matching element is planar and extends substantially perpendicular to the ground plane.

3. The antenna structure of claim 1, wherein the first conductive element is electrically connected to the loading plate and the second conductive matching element is electrically connected to the first conductive element.

4. The antenna structure of claim 3, wherein the second conductive matching element extends from the first conductive element toward the first conductive matching element.

5. The antenna structure of claim 4, wherein the second conductive matching element extends substantially parallel to the ground plane and the loading plate.

6. The antenna structure of claim 5, further comprising a second conductive element extending from the first conductive element to the first conductive matching element.

7. The antenna structure of claim 1, further comprising a first dual band conductive element extending from the second conductive matching element toward the ground plane.

8. The antenna structure of claim 7, further comprising a second dual band conductive element extending from the first conductive element away from the second conductive matching element.

9. The antenna structure of claim 1, further comprising a third conductive element electrically connected to the second conductive matching element and extending from the second conductive matching element towards the ground plane.

10. The antenna structure of claim 1, wherein the common plane extends along a mid-line of the loading plate.

11. The antenna structure of claim 1, further comprising a second conductive element extending along the common plane from the first conductive element to the first conductive matching element.

12. The antenna structure of claim 1, further comprising a first dual band conductive element extending along the common plane from the second conductive matching element toward the ground plane.

13. The antenna structure of claim 12, further comprising a second dual band conductive element extending along the common plane from the first conductive element away from the second conductive matching element.

14. The antenna structure of claim 1, further comprising a third conductive element electrically connected to the second conductive matching element and extending from the second conductive matching element along the common plane towards the ground plane.

15. The antenna structure of claim 1, wherein the integral conductive structure further comprises a first dual band conductive element extending along the common plane from the second conductive matching element toward the ground plane.

16. The antenna structure of claim 1, wherein the integral conductive structure further comprises a second dual band conductive element extending along the common plane from the first conductive element away from the second conductive matching element.

17. The antenna structure of claim 1, wherein the integral conductive structure is at least one conductive layer on an insulating substrate.

18. The antenna structure of claim 17, wherein the loading plate is at least one conductive layer on an insulating substrate.

19. An antenna structure, comprising:

a ground plane;

a loading plate spaced from the ground plane in a direction substantially perpendicular to the ground plane and extending substantially parallel to the ground plane;

a first conductive matching element extending from the loading plate toward the ground plane, wherein the first conductive matching element is electrically connected to the loading plate and is electrically isolated from the ground plane;

a first conductive element extending from the loading plate toward the ground plane; and a second conductive matching element extending from the first conductive element spaced from and between the ground plane and the loading plate;

wherein the first conductive matching element, the first conductive element and the second conductive matching element are in a common plane, the common plane extending substantially perpendicular to the loading plate and the ground plane, wherein the first conductive matching element, the first conductive element and the second conductive matching element comprise an integral conductive structure, and wherein the integral conductive structure further comprises a first dual band conductive element extending along the common plane from the second conductive matching element toward the ground plane.

20. An antenna structure, comprising:

a ground plane;

a loading plate spaced from the ground plane in a direction substantially perpendicular to the ground plane and extending substantially parallel to the ground plane;

a first conductive matching element extending from the loading plate toward the ground plane, wherein the first conductive matching element is electrically connected to the loading plate and is electrically isolated from the ground plane;

a first conductive element extending from the loading plate toward the ground plane; and a second conductive matching element extending from the first conductive element spaced from and between the ground plane and the loading plate;

wherein the first conductive matching element, the first conductive element and the second conductive matching element are in a common plane, the common plane extending substantially perpendicular to the loading plate and the ground plane, wherein the first conductive matching element, the first conductive element and the second conductive matching element comprise an integral conductive structure, and wherein the integral conductive structure further comprises a third conductive element electrically connected to the first conductive matching element and extending from the first conductive matching element along the common plane towards the ground plane.

* * * * *